US006356293B1

(12) United States Patent
Chiba

(10) Patent No.: US 6,356,293 B1
(45) Date of Patent: Mar. 12, 2002

(54) PRINTER INCLUDING A PLURALITY OF PRINT DRUMS

(75) Inventor: Hiroyuki Chiba, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/609,064

(22) Filed: Jun. 30, 2000

(30) Foreign Application Priority Data

Jun. 30, 1999 (JP) ..... 11-184842

(51) Int. Cl.[7] ..... B41J 2/435
(52) U.S. Cl. ..... 347/262; 347/264
(58) Field of Search ..... 347/221, 116, 347/152, 262, 264; 399/96, 117; 346/138, 132; 101/79, 85, 110, 114, 116, 485, 486

(56) References Cited

U.S. PATENT DOCUMENTS

| | | | | | |
|---|---|---|---|---|---|
| 5,130,751 | A | * | 7/1992 | Sato et al. | 399/96 |
| 5,642,663 | A | * | 7/1997 | Hara | 101/116 |
| 6,067,902 | A | | 5/2000 | Takahashi | 101/118 |
| 6,120,013 | A | * | 10/2000 | Takasawa et al. | 101/114 |
| 6,227,107 | B1 | * | 5/2001 | Hashimoto et al. | 101/116 |

FOREIGN PATENT DOCUMENTS

| | | |
|---|---|---|
| JP | 61-85462 | 6/1986 |
| JP | 64-18682 | 1/1989 |
| JP | 64-46258 | 3/1989 |
| JP | 5-229243 | 9/1993 |
| JP | 6-71998 | 3/1994 |
| JP | 6-293175 | 10/1994 |
| JP | 7-1817 | 1/1995 |
| JP | 7-17013 | 1/1995 |
| JP | 8-39916 | 2/1996 |
| JP | 8-39918 | 2/1996 |
| JP | 10-846 | 1/1998 |
| JP | 10-109470 | 4/1998 |
| JP | 11-138961 | 5/1999 |
| JP | 11-151852 | 6/1999 |

* cited by examiner

*Primary Examiner*—N. Le
*Assistant Examiner*—Hai C. Pham
(74) *Attorney, Agent, or Firm*—Oblon, Spivak, McClelland, Maier & Neustadt, P.C.

(57) ABSTRACT

A printer of the present invention includes at least a first and a second drum unit each including a respective print drum. Angular position sensing device each are assigned to the respective print drum. A main motor included in drum drive mechanism is controlled on the basis of the output of a first or a second drum unlock key such that the print drum of the first or second drum unit is brought to a preselected home position. The printer has a compact configuration and promotes easy, efficient manipulation without resorting to conventional top-bottom movement adjustment mechanism including top-bottom moving device.

49 Claims, 18 Drawing Sheets

DRUM 1a DISMOUNT POSITION

DRUM 1b DISMOUNT POSITION

PRINTER INCLUDING A PLURALITY OF PRINT DRUMS

BACKGROUND OF THE INVENTION

FIELD OF THE INVENTION

The present invention relates to a stencil printer or similar printer and more particularly to a color printer including a plurality of print drums around which masters are to be wrapped.

DISCUSSION OF THE BACKGROUND

A thermal, digital master making type of stencil printer belongs to a family of relatively simple printers. In this type of stencil printer, a stencil is caused to contact a thermal head having fine heat generating elements arranged thereon. While the stencil is conveyed, the heat generating elements are selectively energized in accordance with image data so as to selectively perforate the stencil with heat. The perforated stencil, or master as referred to hereinafter, is wrapped around a print drum implemented as a porous hollow cylinder. Ink feeding means arranged in the print drum feeds ink to the inner periphery of the print drum. A press roller or similar pressing member presses a paper sheet or similar recording medium conveyed thereto against the print drum via the master. As a result, the ink is transferred from the print drum to the paper sheet via the porous portion of the print drum and the perforation pattern of the master, printing an image on the paper sheet.

Assume that a master making device and a master discharging device are physically separate from the printer, that the print drums of the printer are mechanically interlocked to each other, and that all of the print drums are removed from the printer in the event of master making and master discharging and again inserted into the printer. Then, the print drums cannot be removed from or inserted into the printer at the same time unless the distance between nearby print drums is an integral multiple of the circumferential length of each print drum in order to provide all of the print drums with an identical home position. This, however, makes the entire printer bulky. In light of this, the distance between nearby print drums may be made shorter than the circumferential length of each print drum with a preselected initial phase difference provided between the drums, thereby making the printer compact. This kind of scheme is taught in, e.g., Japanese Patent Application Nos. 9-321702 and 10-167322 and Japanese Patent Laid-Open Publication Nos. 11-138961 and 11-151852.

Specifically, the above Laid-Open Publication Nos. 11-138961 and 11-151852 disclose technologies that free the operator of a single drum type stencil printer from troublesome operation in the event of color printing. Further, assume that a color stencil printer including a plurality of print drums produces, e.g., a tetracolor or full-color print. Then, the operator of such a printer sometimes desires to replace two print drums assigned to a first and a second color, respectively, at the same time or to remove a paper sheet jamming a path between the two print drums without scratching mesh screens wrapped around the drums. To meet such a demand, in a printer of the previously described type spacing nearby drums by a distance shorter than the circumferential length of each print drum and providing an initial phase difference between the print drums, the above technologies automatically move the individual print drum to a dismount position by using top-bottom movement adjusting means including top-bottom moving means. The top-bottom movement adjusting means is essential for multicolor printing.

However, the problem with Laid-Open Publication No. 11-138961 is that the top-bottom movement adjusting means must rotate the individual print drum by a phase corresponding to the circumferential length of several ten millimeters or to adjust the top-bottom movement (amount of phase adjustment) by an angle of 90° or more with the top-bottom moving means. The adjusting means therefore makes the printer bulky although the initial phase difference makes it compact.

Moreover, the above conventional technologies have been proposed in the initial stage of development and, of course, have various problems left unsolved as to making the operation easy and efficient for the operator to perform.

Technologies relating to the present invention are also disclosed in, e.g., Japanese Utility Model Laid-Open Publication No. 64-46258, Japanese Patent Laid-Open Publication Nos. 5-229243, 6-71998, 6-293175, 7-1817 and 7-17013, Japanese Utility Model Laid-Open Publication No. 61-85462, and Japanese Patent Laid-Open Publication Nos. 8-39916, 8-39918, 10-109470, 10-846, and 64-18682.

SUMMARY OF THE INVENTION

It is therefore an object of the present invention to provide an improved compact printer not needing the top-bottom movement adjusting means and allowing a plurality of print drums to be mounted thereto by simple operation.

It is another object of the present invention to provide a printer that is easy and efficient to operate.

A printer of the present invention includes a plurality of drum units removably mounted to a printer body and each including a respective print drum allowing a particular master to be wrapped therearound. Nearby print drums are provided with a preselected initial phase difference therebetween beforehand when the drum units are present in the printer body. The drum units each are removable from the printer body when the respective print drum is brought to a preselected phase. The printer wraps masters around the print drums, feeds ink of particular color to each master, and presses a recording medium against the consecutive masters to thereby effect continuous printing. Individual removal setting devices each are assigned to a particular drum unit for making the drum unit removable from the printer body. Angular position sensing means each sense the angular position of the drum of a particular drum unit. A drum drive arrangement causes the print drum of the drum unit to be removed to rotate. A controller controls, based on the output of the individual removal setting device assigned to the drum unit to be removed and the output of the angular position sensing means assigned to the print drum of the same drum unit, the drum drive arrangement such that the print drum of the drum unit to be removed is brought to the preselected phase.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
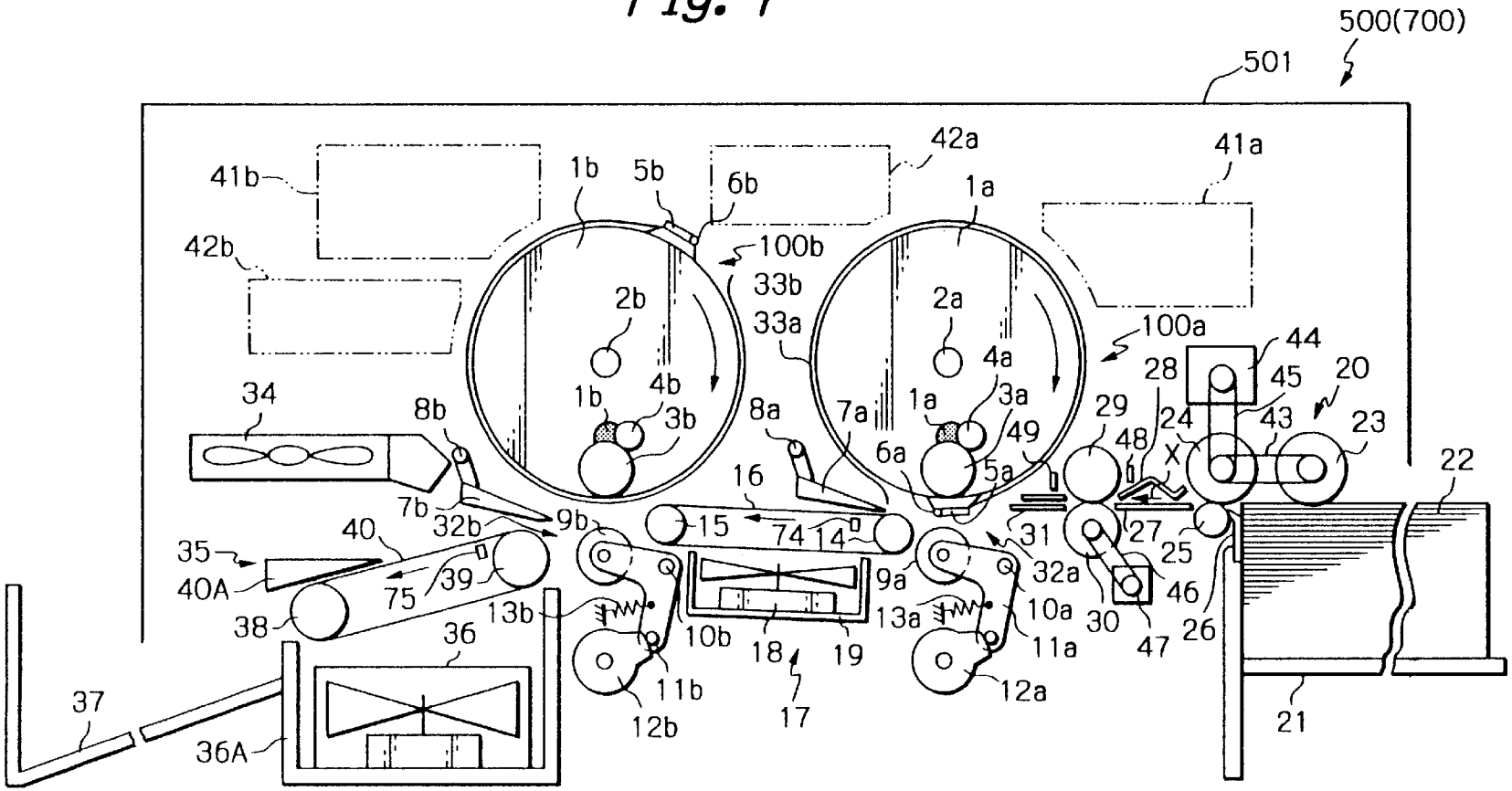
FIG. 1 is a front view showing the general construction of a stencil printer embodying the present invention, as seen from the front of a housing printer body.

A stencil printer embodying the present invention will be described hereinafter with reference to the accompanying drawings. In the figures and description to follow, structural elements identical in configuration and function are designated by identical reference numerals and will not be repeatedly described in order to avoid redundancy. To simplify the figures and description, parts and elements not relevant to the understanding of the illustrative embodiment will not be described. Further, as for parts and elements provided in pairs and not needing distinction, only one of them will be described for simplicity.

Referring to FIG. 1 of the drawings, a stencil printer embodying the present invention is shown and generally designated by the reference numeral 500. As shown, the printer 500 includes a box-like housing or printer body 501. A first print drum 1*a* and a second print drum 1*b* are positioned side by side in a direction X in which a paper sheet 22 is conveyed (direction of paper conveyance X hereinafter). In this sense, the print drums 1*a* and 1*b* are located at an upstream side and a downstream side, respectively. The print drums 1*a* and 1*b* are removably mounted to the housing 501. Masters 33*a* and 33*b* are wrapped around the print drums 1*a* and 1*b*, respectively. Ink of a particular color is fed to each of the masters 33*a* and 33*b* via the associated print drum 1*a* or 1*b*. In this condition, the paper sheet 22 is sequentially pressed against the masters 33*a* and 33*b*. As a result, a color image (bicolor image in the illustrative embodiment) is printed on the paper sheet 22.

While the illustrative embodiment includes only two print drums 1*a* and 1*b* spaced in the direction of paper conveyance X, three or more print drums can, of course, be sequentially arranged in the direction X in order to produce a color print.

Figure 2:
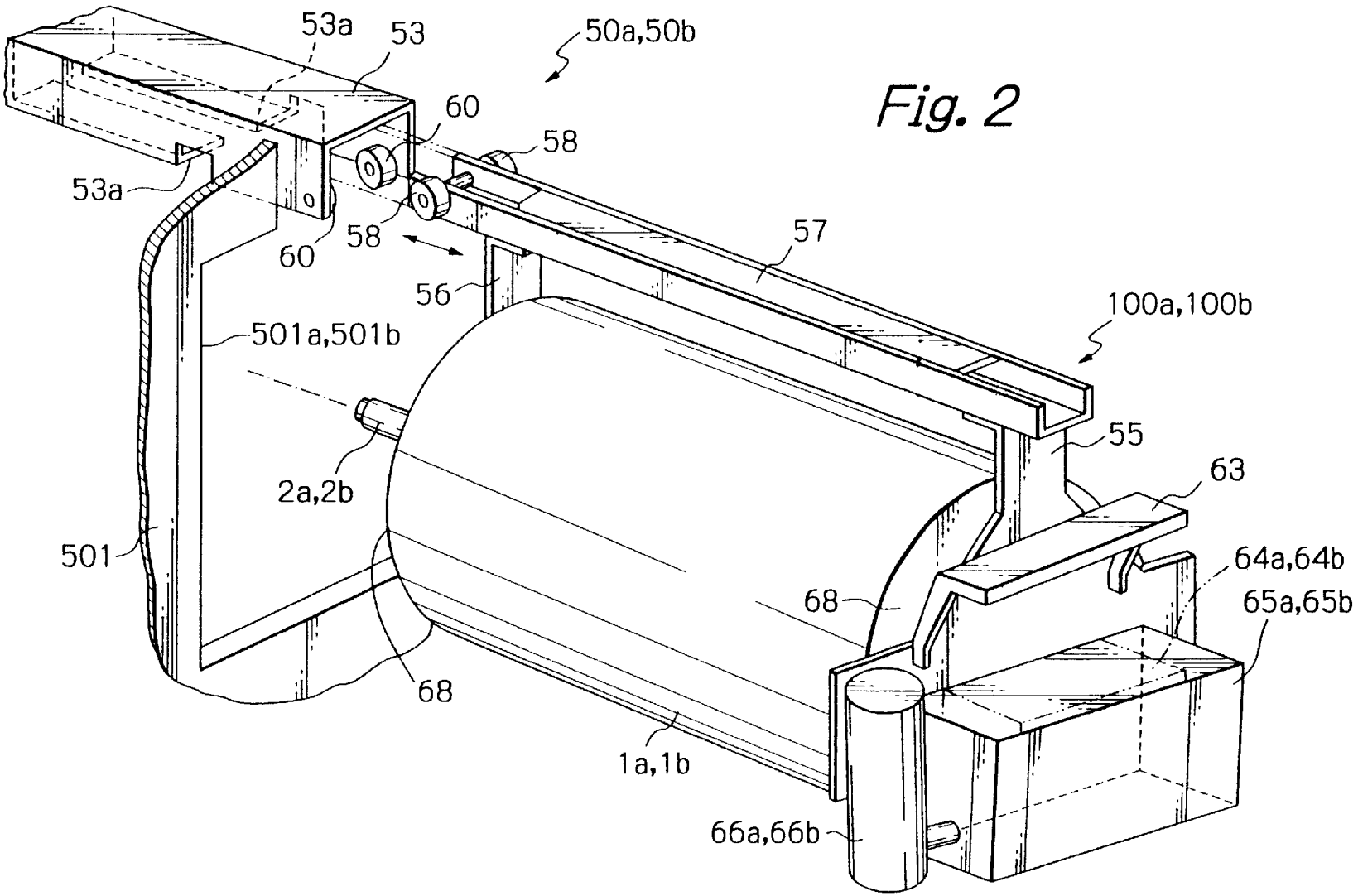
FIG. 2 is a fragmentary isometric view showing mounting/dismounting means and a drum unit included in the illustrative embodiment together with members associated therewith.
Figure 8:
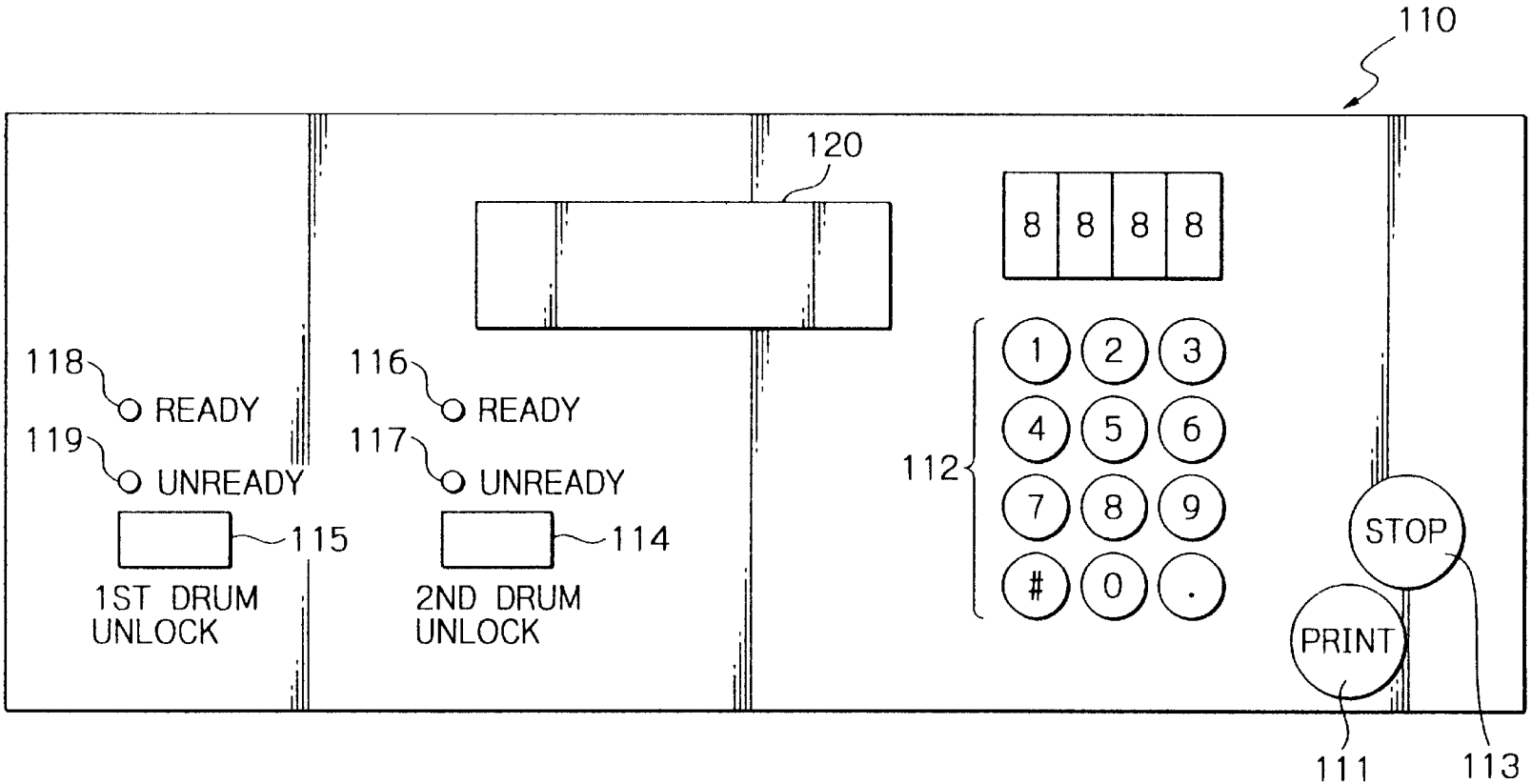
FIG. 8 is a plan view showing a specific configuration of an operation panel included in the illustrative embodiment.
Figure 9:
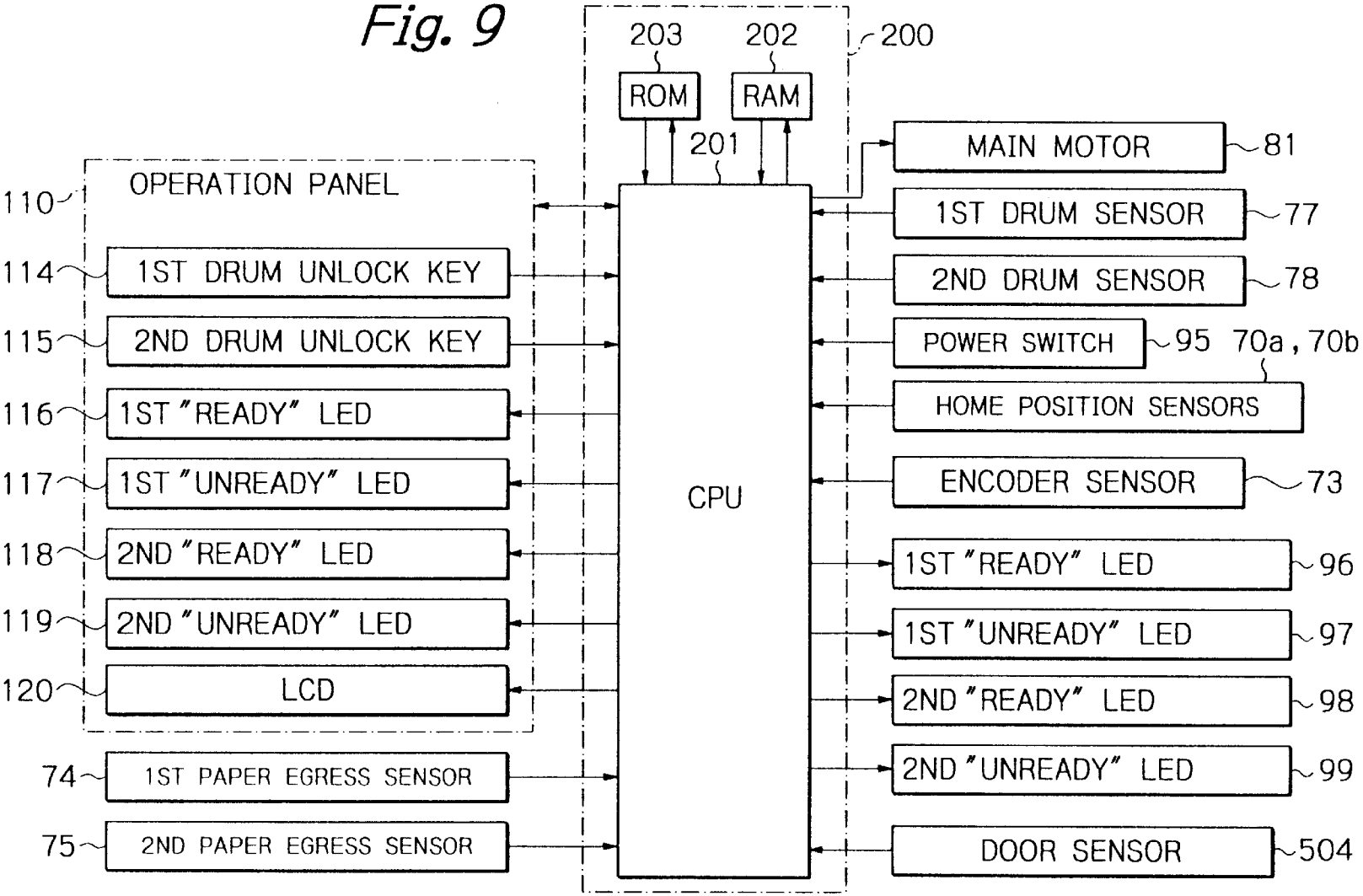
FIG. 9 is a block diagram schematically showing a control system included in the illustrative embodiment.

FIGS. 4A through 4C and FIG. 5 show drum drive means 80 for causing the print drums 1*a* and 1*b* to rotate. FIG. 2 shows mounting/dismounting means 50*a* and 50*b* for respectively allowing the print drums 1*a* and 1*b* to be mounted and dismounted from the housing 501. FIG. 8 shows a specific arrangement of an operation panel 110 for allowing the operator to operate the printer 500. FIG. 9 shows control circuitry including a controller 200.

Home positions different from the home positions taught in Japanese Patent Laid-Open Publication No. 11-138961 mentioned earlier are assigned to the print drums 1*a* and 1*b*. For example, the home positions are such that dampers 5*a* and 5*b* (see FIG. 1) mounted on the print drums 1*a* and 1*b*, respectively, are positioned substantially at the bottoms of the drums 1*a* and 1*b*.

The general construction of the printer 500 will be described first with reference to FIG. 1, and then details of the mounting/dismounting means 50*a* and 50*b*, drum drive means 80, operation panel 110 and controller 200 will be described. It is to be noted that master making devices 41*a* and 41*b* and master discharging devices 42*a* and 42*b* are indicated by phantom lines because they are not used or arranged in the illustrative embodiment.

The print drums 1*a* and 1*b* are substantially identical in configuration and function, and so are the mounting/dismounting means 50*a* and 50*b*. Also, ink feeding means assigned to the print drum 1*a* and ink feeding means assigned to the print drum 1*b*, as will be described specifically later, are substantially identical in configuration and operation. Such identical structural elements are distinguished from each other by suffixes a and b, and only one of them will be described as far as possible in order to avoid redundancy.

The printer 500 is generally identical with a printer shown in FIG. 4 of Japanese Patent Application No. 10-167322 mentioned earlier except for the above-described unique arrangements. Specifically, as shown in FIG. 1, a sheet feeder 20 is positioned below and rightward of the print drum 1*a* around which the master 33*a* is wrapped. The sheet feeder 20 feeds paper sheets 22 stacked on a paper tray 21 one by one. A pressing device 32*a* is arranged below the print drum 1*a* for pressing the paper sheet 22 conveyed thereto against the master 33*a* so as to print an image of a first color on the paper sheet 22. An air knife 7*a* peels off the paper sheet 22 carrying the above image thereon from the print drum 1*a*. A pressing device 32*b* is positioned below the print drum 1*b*, around which the master 33*b* is wrapped, and presses the paper sheet 22 against the master 33*b* in order to print an image of a second color on the paper sheet 22 over the image of the first color. An intermediate conveying device 17 conveys the paper sheet 22 from the pressing device 32*b* to the pressing device 32*b*. An air knife 7*b* peels off the paper sheet 22 carrying the resulting bicolor image thereon from the print drum 1*b*. A paper discharging device 35 conveys the paper sheet or bicolor print 22 to a print tray 37 and includes the air knife 7*b*.

In the illustrative embodiment, the master making devices 41*a* and 41*b*, master discharging devices 42*a* and 42*b* and a scanner usually arranged above the devices 41*a* through 42*b* are absent. Specifically, assume an integrated stencil printer with a thermal digital master making capability and equipped with a scanner, a master discharging device and a master making device separate from the printer 500. Then, the used masters 33*a* and 33*b* wrapped around the print drums 1*a* and 1*b,* respectively, are discharged via drum units 100*a* and 100*b* while new masters 33*a* and 33*b* are wrapped around the drums 1*a* and 1*b,* respectively, via the drum units 100*a* and 100*b,* as shown in FIG. 4 of the previously mentioned Application No. 10-167322. The printer 500 shares the same drum units and other structural parts with the above-described type of integrated stencil printer and is therefore simple, small size and low cost.

The print drum 1*a* is a conventional porous hollow cylinder rotatable about a shaft 2*a* and extending in the axial direction of the shaft 2*a*. The print drum 1*a,* like a print drum shown in FIG. 4 of Laid-Open Publication No. 11-138961 mentioned earlier, has a double layer structure made up of a metallic, hollow cylindrical core and a mesh screen layer wrapped around the core, although not shown specifically. The core is formed with a number of pores permeable to ink. The mesh screen layer is formed of resin or metal. More specifically, the core has a printing area formed with the pores and a non-printing area not formed with the pores and not permeable to ink. The printing area extends over a preselected circumferential range of the core except for a position where the damper 5*a* is located. The non-printing range is also formed at opposite axial edge portions of the core.

As shown in FIG. 1, the damper 5*a* is openably mounted on the print drum 1*a* and extends in the axial direction of the drum 1*a* for clamping the leading edge of the master 33*a*. The damper 5*a* is angularly movably mounted on the print drum 1*a* via shaft 6*a*. Opening/closing means, not shown, is located at a suitable position around the print drum 1*a* for causing the damper 5*a* to open and close at a preselected position.

As shown in FIG. 2, the print drum 1*a* has opposite ends thereof fastened to the circumferential surfaces of two end plates 68 by screws. A roller bearing, not shown, is interposed between the center of each end plate 68 and the shaft 2*a*. The print drum 1*a* is rotatably mounted on the shaft 2*a* via the roller bearings while the shaft 2*a* is supported by a front frame 55 and a rear frame 56. A main motor 81 (see FIGS. 4A and 5) drives the ink drum 1*a*.

As shown in FIG. 1, ink feeding means is arranged in the print drum 1*a* for feeding ink of a first color from the inner periphery to the outer periphery of the drum 1*a*. Likewise, ink feeding means is arranged in the print drum 1*b* for feeding ink of a second color from the inner periphery to the outer periphery of the drum 1*b*. In the illustrative embodiment, the first and second colors are assumed to be black and magenta, respectively. The ink feeding means arranged in the print drum 1*a* includes an ink roller 3*a* for applying the black ink to the inner periphery of the drum 1*a*. A doctor roller 4*a* is parallel to the ink roller 3*a* and spaced from the ink roller 3*a* by a small gap, forming an ink well 1*a* therebetween. An ink feed tube 2*a* for feeding the ink to the ink well 1*a* serves as the shaft 2*a* at the same time.

The drum unit 100*a,* which will be described specifically later with reference FIG. 2 and other figures, includes an ink cartridge 64*a* and an ink pump 66*a* for feeding compressed ink from the cartridge 64*a*. The ink fed from the ink cartridge 64*a* is delivered to the ink well 1*a* via the ink feed tube 2*a*. Ink sensing means (see, e.g., FIG. 5 of Laid-Open Publication No. 5-229243 mentioned earlier) senses the amount of ink existing in the ink well 1*a*. The delivery of the ink from the ink pump 66*a* is controlled on the basis of the output of the ink sensing means.

The ink roller 3*a* is formed of, e.g., aluminum, stainless steel, metal or rubber and caused to rotate clockwise by a gear train, not shown, together with the print drum 1*a*. A preselected ratio is set between the rotation speed of the ink roller 3*a* and that of the print drum 1*a*. The doctor roller 4*a* is formed of iron, stainless steel or similar metal and caused to rotate counterclockwise by a gear train not shown. A preselected ratio is also set between the rotation speed of the doctor roller 4*a* and the print drum 1*a*.

The master 33*a* is implemented by a laminate of a film formed of polyester or similar thermoplastic resin and a porous base implemented by, e.g., Japanese paper. Alternatively, use may be made of a master substantially consisting only of an extremely thin thermoplastic resin film 1 $\mu$m to 8 $\mu$m thick), a thin master (20 $\mu$m to 30 $\mu$m thick) not as thin as the above master, but thinner than the master 33*a* (about 40 $\mu$m to 50 $\mu$m thick), and including a base that contains a substantial amount of synthetic fibers, e.g., a base entirely implemented by polyethylene terephthalate (PET).

The sheet feeder 20 includes the previously mentioned paper tray 21 driven by a motor, not shown, in the up-and-down direction in accordance with the increase/decrease in the amount of the sheet stack 22. A pickup roller 23 and a separator roller 24 are journal led to opposite sidewalls, not shown, included in the sheet feeder 20. A separator roller 25 is pressed against the separator roller 24 for preventing two or more paper sheets 22 from being fed together. An upper and a lower registration roller 29 and 30 convey the leading edge of the paper sheet 22 toward a gap between the ink drum 1*a* and the press roller 9*a* at a preselected timing. An upper and a lower guide plate 28 and 27 guide the leading edge of the paper sheet 22 to a nip between the registration rollers 29 and 30. An upper and a lower registration guide plate 31 guide the paper sheet 22 further to the gap between the ink drum 1*a* and the press roller 9*a*. A paper feed motor 44 independent of the main motor 81 causes the pickup roller 23 and separator roller 24 to rotate. A registration motor 47 also independent of the main motor 81 causes the registration rollers 29 and 30 to rotate. A paper lead edge sensor 48 is located on a paper transport path between the separator roller 24 and the registration rollers 29 and 30 for sensing the leading edge of the paper sheet 22. A registration sensor 49 is located in a paper transport path between the print drum 1*a* and the registration rollers 29 and 30 for sensing the leading edge of the paper sheet 22.

The pickup roller 23 and separator rollers 24 and 25 contact the top sheet 22 existing on the paper tray 21. While the pickup roller 23 pays out the top paper sheet 22 from the paper tray 21, the separator rollers 24 and 25 and separator plate 26 cooperate to separate the top paper sheet 22 from the under lying paper sheets 22. The pickup roller 23, separator rollers 24 and 25 and separator plate 26 constitute paper feeding means for feeding the leading edge of the top paper sheet 22 toward the registration rollers 29 and 30.

The paper feed motor 44 is implemented by a stepping motor and plays the role of paper feed drive means for causing the separator roller 24 and pickup roller 23 to rotate. The paper feed motor 44 is drivably connected to the separator roller 24 via a toothed endless belt 45. The belt 45 is passed over a drive pulley mounted on the output shaft of the motor 44 and a driven pulley mounted on the shaft of the separator roller 24. In this configuration, the motor 44 causes the separator roller 24 to rotate clockwise. A one-way clutch, not shown, is arranged on each of the shafts of the rollers 23 and 24, so that the rollers 23 and 24 are rotatable only in the clockwise direction via the belt 45.

The leading edge of the paper sheet 22 fed from the paper tray 21 abuts against a portion of the registration rollers 29 and 30 just short of the nip between the rollers 29 and 30. The paper sheet 22 then forms a loop convex upward along the upper guide plate 28. The registration rollers 29 and 30 then nips the leading edge of the paper sheet 22 and conveys it to the gap between the print drum 1*a* and the press roller 9*a* at a preselected timing.

The registration motor 47 is implemented by a stepping motor and plays the role of registration drive means for causing the lower registration roller 30 to rotate. A toothed endless belt 46 is passed over a drive pulley mounted on the output shaft of the registration motor 47 and a driven pulley mounted on the shaft of the registration roller 30. The motor 47 is therefore drivably connected to the registration roller 30 via the belt 46.

The paper lead edge sensor 48 and registration sensor 49 each are implemented by a reflection type optical sensor having a light emitting portion and a light-sensitive portion. The upper guide plate 28 and upper registration guide plate 31 are formed with holes for passing light issuing from the light emitting portions and holes for passing the light reflected from the leading edges of the paper sheet 22, although not shown specifically. The paper lead edge sensor 48 responsive to the leading edge of the paper sheet 22 detects a jam occurred at the upstreamside, including the paper feeding means, in the direction of paper conveyance X. In addition, the sensor 48 implements part of a function of adjusting the amount of the loop that the leading edge of the paper sheet 22 forms.

The registration sensor 49 also responsive to the leading edge of the paper sheet 22 detects a jam occurred at the upstream side, including the registration rollers 29 and 30, in the direction of paper conveyance X. In addition, the sensor 49 sends its output to a control unit, not shown, for correcting the amount of slip of the paper sheet 22 that occurs at the registration rollers 29 and 30 and varies in accordance with the kind of the paper sheet 22.

The pressing device 32*a* includes a bracket 11*a*, tension spring 13*a* and a cam 12*a* having a pear-shaped profile in addition to the ink roller 3*a* and press roller 9*a*. The press roller 9*a* plays the role of pressing means for pressing the paper sheet 22 against the print drum 1*a*, as stated earlier. The press roller 9*a* is rotatably supported by one end of the bracket 11*a* such that it is movable into and out of contact with the print drum 1*a*. The tension spring 13*a* is anchored to the other end of the bracket 11*a* and determines the pressure that the press roller 9*a* exerts on the print drum 1*a*. The end of the bracket 11*a* is pressed against the profile of the cam 12*a* by the bias of the tension spring 13*a*. The cam 12*a* is connected to the drum drive means 80, including the main motor 81, and caused to rotate thereby in synchronism with the paper feed from the paper feeder 20 and the rotation of the print drum 1*a*. When the paper feeder 20 does not feed any paper sheet 22, a larger diameter portion included in the cam 12*a* contacts the end of the bracket 11*a* facing the cam 12*a*. When the paper feeder 20 feeds the paper sheet 22, the cam 12*a* is rotated to brings its smaller diameter portion into contact with the end of the bracket 11*a*, causing the press roller 9*a* to rotate clockwise as viewed in FIG. 1. At this time, the pressure derived from the tension spring 13*a* is transferred to the print drum 1*a*.

The air knife 7*a* has its edge implemented as a nozzle for preventing the paper sheet 22 from adhering to the print drum 1*a* and rolling up. Specifically, a pump or compressed air source, not shown, delivers air under pressure to the nozzle of the air knife 7*a*. As a result, a jet of air is sent from the nozzle to the leading edge of the paper sheet 22 at a high velocity. The air knife 7*a* is angularly movable about a shaft 8*a* between an operative position where it adjoins the print drum 1*a* for peeling off the paper sheet 22 from the print drum 1*a* and an inoperative position where it is spaced from the print drum 1*a*. That is, the air knife 7*a* is movable between the two positions in synchronism with the rotation of the print drum 1*a* so as not to interfere with the damper 5*a*. A blast fan 34 is located at the left-hand side of the other air knife 7*b*. The blast fan 34 helps the air knife 7*b* separate the paper sheet 22 from the print drum 1*b* and prevent it from rolling up together with the print drum 1*b*.

The intermediate conveying device 17 includes a porous belt 16 passed over a drive roller 15 and a driven roller 14, a suction fan 18, and a casing 19. At least the surface of the belt 16 is formed urethane rubber or similar material having a great coefficient of friction with respect to the paper sheet 22. The belt 16 therefore pulls the paper sheet 22 to the left, as viewed in FIG. 1. At this time, however, the upstream portion of the paper sheet 22 in the direction of paper conveyance X is still nipped between the print drum 1*a* and the press roller 9*a*. The paper sheet 22 therefore moves to the left at a speed equal to the peripheral speed of the print drum 1*a*.

The belt 16 is driven in synchronism with the print drum 1*a* at a speed equal to or slightly higher than the peripheral speed of the print drum 1*a*. The belt 16 therefore conveys the paper sheet 22 while applying leftward tension thereto. The suction fan 18 is disposed in the casing 19 and generates vacuum in the casing 19.

The paper discharging device 35 includes a porous belt 40 passed over a drive roller 38 and a driven roller 39, a jump board 40A, a suction fan 36, and a casing 36A. The belt 40 is driven in synchronism with the print drum 1*b* at a speed substantially equal to the peripheral speed of the drum 1*b*. Air sent from the blast fan 34 hits against the surface of the paper sheet or print 22 from a position above and leftward of the air knife 7*b*. This air not only prevents the paper sheet 22 from rising above the belt 40, but also promotes the drying of the ink existing on the paper sheet 22. The jump board 40A causes the center portion of the paper sheet 22 to deform in the form of a letter U, i.e., provides the paper sheet 22 with an adequate degree of stiffness, so that the consecutive paper sheets 22 can be neatly stacked on the print tray 37.

As shown in FIGS. 1 and 6, a first paper egress sensor or sensing means 74 is positioned downstream of the print drum 1*a* of the drum unit 100*a* in the direction of paper conveyance X. The paper egress sensor 74 is responsive to the roll-up and defective egress, or egress error, of the paper sheet 22. Likewise, a second paper egress sensor or sensing means 75 is positioned downstream of the print drum 1*b* of the drum unit 100*b* in the direction of paper conveyance X and also responsive to the roll-up and defective egress of the paper sheet 22.

The paper egress sensors 74 and 75 each are implemented as a reflection type photosensor similar to a roll-up sensor 50 shown in FIG. 6 of Laid-Open Publication No. 11-151852 mentioned earlier. The belt 16 included in the intermediate conveying device 17 is divided into a plurality of spaced segments. The first paper egress sensor 74 is positioned beneath a gap between the segments of the belt 16. Likewise, the second paper egress sensor 75 is positioned beneath a gap between spaced segments constituting the belt 40 of the paper discharging device 35.

As shown in FIG. 2, the drum unit 100*a* is removably mounted to the housing or printer body 501 via the mounting/dismounting means 50*a*. Likewise, the drum unit 100*b* is removably mounted to the housing 501 via the mounting/dismounting means 50*b*. Openings 501*a* and 501*b* are formed in the front end of the housing 501 for allowing the drum units 100*a* and 100*b*, respectively, to be mounted and dismounted from the housing 501. As shown in FIGS. 3 and 4A through 4C, coupling portions for respectively receiving the rear end portions of the shafts 2*a* and 2*b*, as viewed in FIG. 2, and the drum drive means 80 are arranged in the housing 501 behind the openings 501*a* and 501*b*.

As shown in FIG. 2, the drum unit 100*a* includes a cartridge holder 65*a*, a grip 63, a front frame 55, a rear frame 56 and a handle 57 in addition to the print drum 1*a*, end plates 68, shaft 2*a*, ink feeding means, ink pump 66*a*, and ink cartridge 64*a* storing black ink and received in the cartridge holder 65*a*. Likewise, the drum unit 100*b* includes a-cartridge holder 65*b* for holding an ink cartridge 64*b* storing magenta ink, an ink pump 66*b*, a grip 63, a front frame 55, a rear frame 56 and a handle 57 in addition to the print drum 1*b*, end plates 68, shaft 2*b* and ink feeding means.

The drum units 100*a* and 100*b* can be removed from the housing 501 only when the print drums 1*a* and 1*b* thereof are located at their home positions via a structure and means that will be described specifically later.

The above-described configuration of the drum units 100*a* and 100*b* is extremely convenient when the operator, intending to change the colors, replaces the print drums 1*a* and 1*b* with other print drums. Further, the operator is capable of removing a paper sheet jamming the path between the print drums 1*a* and 1*b* without scratching or otherwise damaging the masters 33*a* and 33*b* wrapped around the drums 1*a* and 1*b*, respectively, or the mesh screens of the drums 1*a* and 1*b*.

The drum units 100*a* and 100*b* are substantially identical in construction and operation, as stated earlier. The print drums 1*a* and 1*b*, shafts 2*a* and 2*b*, structural elements constituting the ink feeding means, mounting/dismounting means 50*a* and 50*b*, ink cartridges 64*a* and 64*b*, cartridge holders 65*a* and 65*b* and ink pumps 66*a* and 66*b* respectively assigned to the print drums 1*a* and 1*b* are distinguished from each other by the suffixes a and b. When one of the corresponding parts is described in detail, the other part will not be described in order to avoid redundancy.

As shown in FIG. 2, the mounting/dismounting means 50*a* includes a pair of rollers 58, a guide rail 53 and a pair of inlet rollers 60 as well as the shaft 2*a*, front frame 55, rear frame 56, and handle 57. The mounting/dismounting means 50*a*, part of which is not shown in FIG. 2, may be constructed in the same manner as a drum support arrangement shown in FIG. 4 of Laid-Open Publication No. 61-85462 mentioned earlier.

Annular affixing members, not shown, are mounted on opposite ends of the shaft 2*a*. The front frame 55 and rear frame 56 through which the shaft 2*a* is passed are fastened to the inner surfaces of the affixing members by screws. The upper ends of the frames 55 and 56 are affixed to opposite ends of the handle 57, which has a top-open channel configuration. The handle 57 supports the rollers 58 at its rear end via a shaft.

The guide rail 53 having a bottom-open channel configuration is affixed to the housing 501 in the upper portion of each of the openings 501*a* and 501*b*. The guide rail 53 extends in the axial direction of the print drum 1*a*. The inlet rollers 60 each are rotatably mounted on the front end or inlet of the guide rail 53 via a respective shaft.

The drum unit 100*a* is inserted into the guide rail 53 with the rollers 58 of the handle 57 at the head, while being guided by the rollers 60. The drum unit 100*a* is pulled out of the guide rail 53 with the rollers 58 at the tail. The guide rails 58 roll on a pair of flanges 53*a* protruding from the side walls of the guide rail 53 toward each other. When the handle 57 is fully received in the guide rail 53, the rear end of the shaft 2*a* is connected to the coupling portion arranged in the housing 501.

Figure 3:
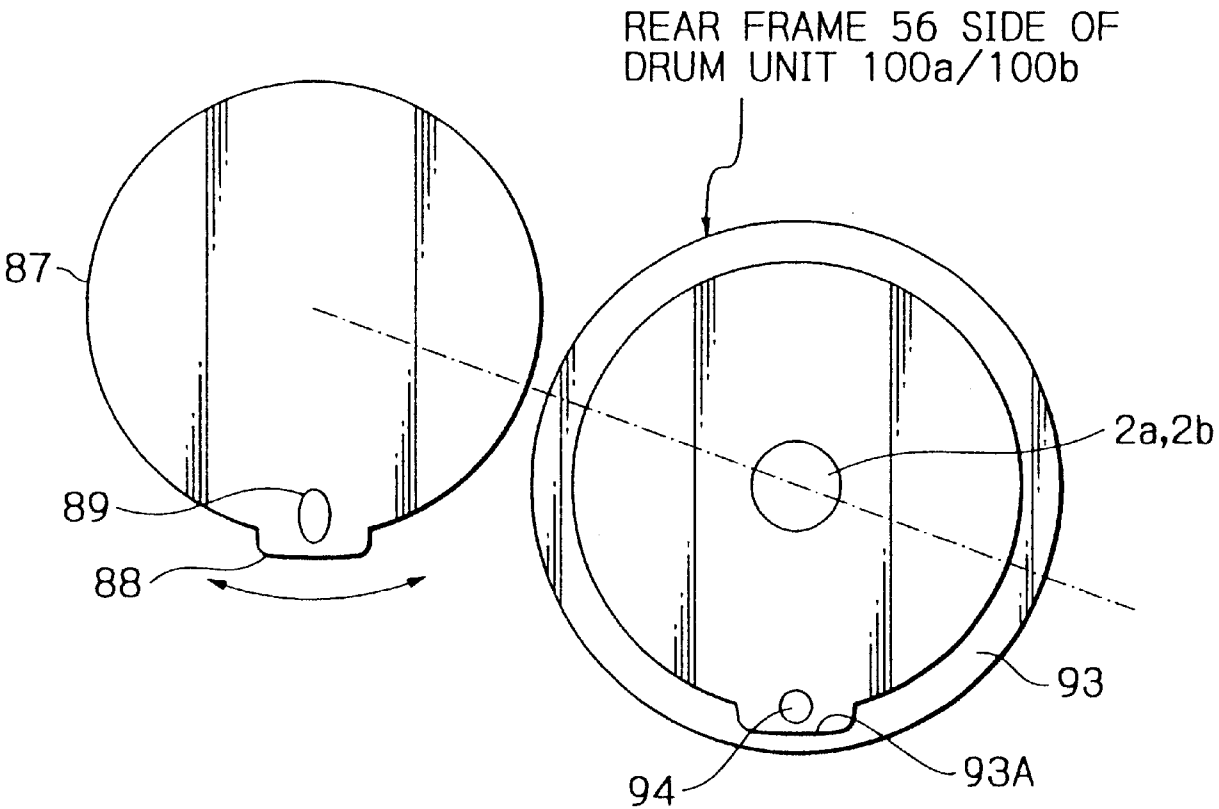
FIG. 3 is a view showing the engagement of locking means included in the illustrative embodiment.
Figure 4A:
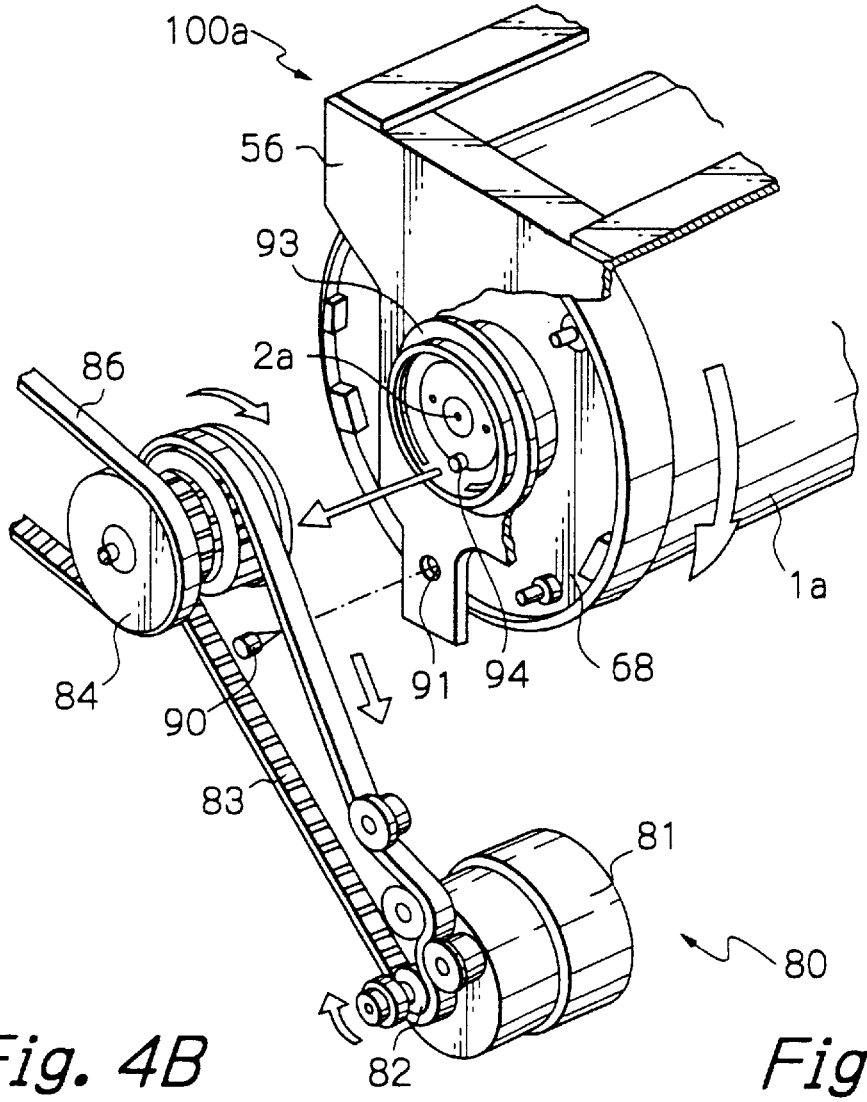
FIG. 4A is an isometric view showing drum drive means and mechanical locking means included in the illustrative embodiment, as seen from the rear of the housing.
Figure 4B:
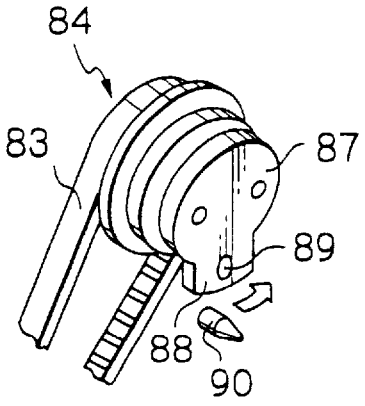
FIG. 4B is a fragmentary isometric view of a coupling portion arranged in the housing.
Figure 4C:
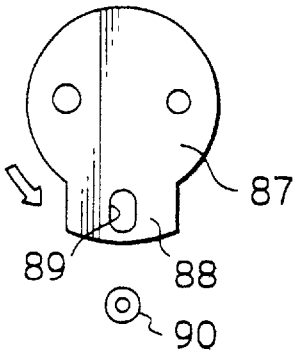
FIG. 4C is a front view of the coupling portion.

As shown in FIGS. 3 and 4A, an annular portion 93 protrudes outward from the rear frame 56 and has a notch 93A at its lower end. The annular portion 93 has an outer inside diameter slightly smaller than an inner inside diameter and is generally L-shaped in a sectional view. A tapered pin 94 is studded on the end plate 78 at a position corresponding to the home position of the print drum 1*a*. The end plate 78 is rotatably supported by the rear end of the shaft 2*a* via the previously mentioned roller bearing. A hole 91 is formed in the lower portion of the rear frame 56 for positioning the drum unit 100*a*.

Figure 7:
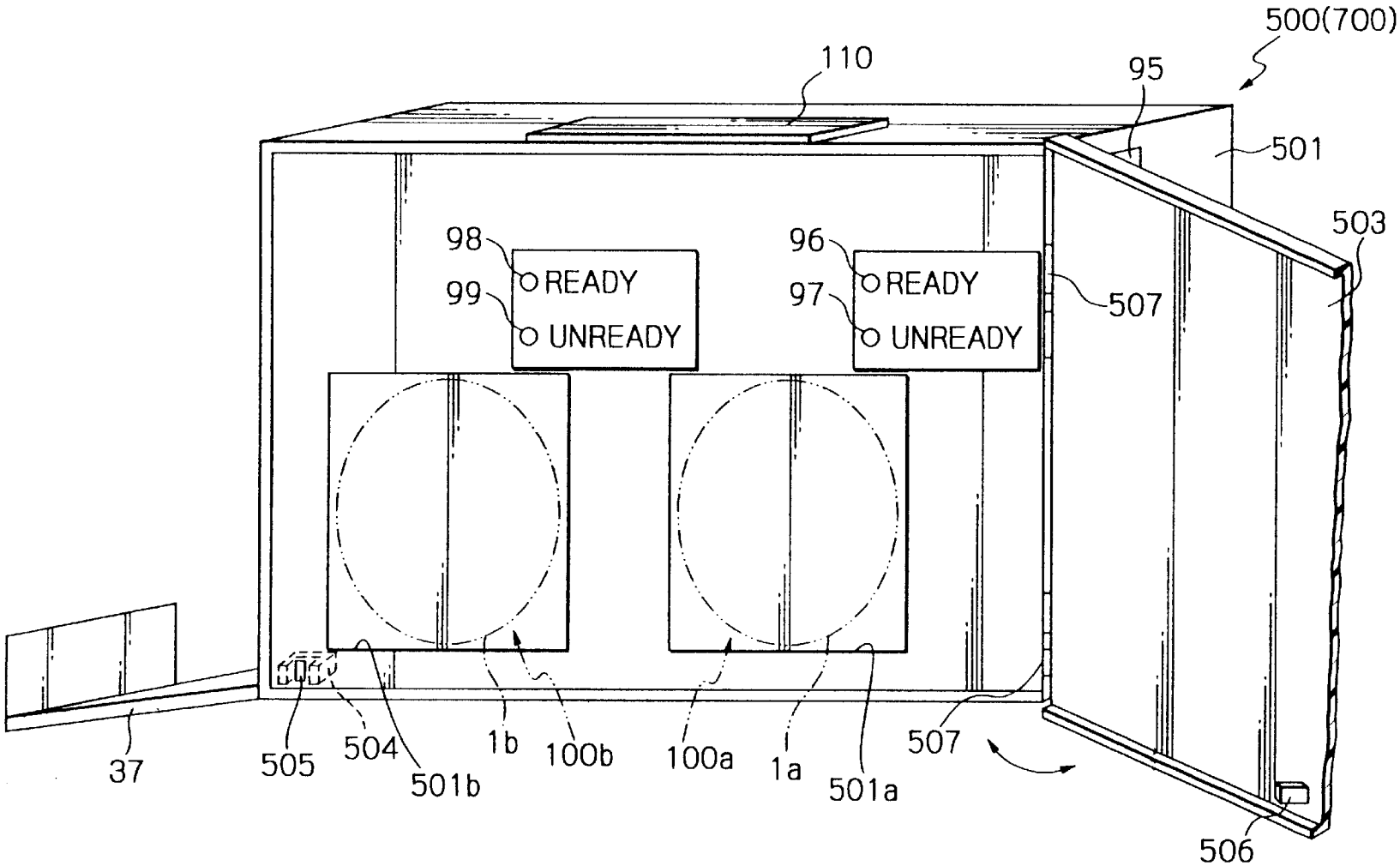
FIG. 7 is a perspective view showing LEDs (Light Emitting Diodes) and a door cover mounted on the housing.

As shown in FIG. 7, a door or openable member 503 is mounted on the housing 501 via hinges 507 so as to selectively cover or uncover the openings 501*a* and 501*b*. The door 503 is implemented by a molding of synthetic resin. A screen member 506 protrudes from the bottom right portion of the door 503, as viewed in FIG. 7, in such a manner as to face the housing 501. In FIG. 7, the screen member 506 is scaled up relative to the door 503 for the sake of illustration.

A door sensor or open/close sensing means 504 is mounted on the bottom left portion of the housing 501, as viewed in FIG. 7, for determining whether or not the door 503 is closed. The door sensor 504 is a transmission type optical sensor including an opening 505. When the door 503 is closed, the screen member 506 enters the opening 505 and causes the door sensor 504 to turn on. A power switch 95 is located on the right side wall of the housing 501 and turned on when power should be fed to the printer 500.

Indicators for showing the operating conditions of the printer 500 are arranged on the housing 501 above the openings 501*a* and 501*b*. Specifically, a first "Ready" LED 96 and a first "Unready" LED 97 are positioned above the opening 501*a* and respectively show that the drum unit 100*a* can be mounted or dismounted and that it cannot be done so. Likewise, a second "Ready" LED 98 and a second "Unready" LED 99 are positioned above the opening 501*b* and respectively show that the drum unit 100*b* can be mounted or dismounted and that it cannot be done so.

The first and second "Ready" LEDs 96 and 98 and first and second "Unready" LEDs 97 and 99 constitute ready/unready displaying means for displaying whether or not the drum units 100*a* and 100*b* can be mounted or dismounted. The "Ready" LEDs 96 and 98 may be green LEDs and may be caused to blink or glow by an LED driver. Also, the "Unready LEDs 97 and 99 may be red LEDs and may be caused to blink or glow by an LED driver.

As shown in FIGS. 4A through 4C and 5, the drum drive means 80 includes drive transmitting means connected to the main motor 81, which is shared by the print drums 1*a* and 1*b*. The drive transmitting means transmits the rotation of the main motor 81 to the print drums 1*a* and 1*b* of the drum units 100*a* and 100*b*. The main motor 81 is implemented by a DC motor provided with conventional brake means.

The drive transmitting means is arranged on a rear wall, not shown, affixed to the casing 501 and includes a drive pulley 82 mounted on the output shaft of the main motor 81. A first drum pulley 84 is rotatably supported by the rear wall in alignment with the print drum 1*a* and implemented by a double pulley. A timing belt 83 is passed over the drive pulley 82 and first drum pulley 84 via a plurality of tension pulleys. A second drum pulley 85 is rotatably supported by the rear wall in alignment with the print drum 1*b*. A timing belt 86 is passed over the first and second drum pulleys 84 and 85.

In addition to the above-described function, the main motor 81 has a function of rotating the print drum 1*a* of the drum unit 100*a* and/or the print drum 1*b* of the drum unit 100*b*, which is to be removed, and a function of rotating drum drive plates 87 assigned to the print drum 1*a* and/or the print drum 1*b*, which is to be inserted, as will be described specifically later. The drum drive plates 87 each are included in the respective coupling portions. While top-bottom moving means is not shown in order to clearly show the characteristic of the drum drive means 80, the illustrative embodiment includes second top-bottom moving means 245 shown in FIGS. 13 and 16 of Laid-Open Publication No. 11-138961 mentioned earlier.

Because the coupling portions respectively assigned to the print drums 1*a* and 1*b* are identical in configuration, let the following description concentrate on the coupling portion assigned to the print drum 1*a*. As shown in FIGS. 3 and 4A through 4C, the coupling portion includes the drum drive plate 87 formed integrally with the first-drum pulley 84 and capable entering the annular portion 93 of the rear frame 56. A lug 88 protrudes downward from the bottom of the drum drive plate 87 and is capable of mating with the notch 93A of the annular portion 93. When the lug 88 mates with the notch 93A, it locks the drum unit 100*a* due to the rotation of the drum pulley 84 and drum drive plate 88 and prevents the drum unit 100*a* from being pulled out. An elongate hole 89 is formed in the drum drive plate 87 for receiving the pin 94 of the print drum 1*a*. A tapered positioning pin 90 is studded on the rear wall of the housing 501 and capable of mating with the hole 91 of the drum unit 100*a*.

When the drum unit 100 is inserted into the housing 501 via the mounting/dismounting means 50*a* in the previously described manner, the drum drive plate 87 enters the annular portion 93 of the rear frame 56 with the notch 93A and lug 88 aligning with each other. At the same time, the pin 90 of the coupling portion enters the hole 91 of the rear frame 56. As a result, the drum unit 100*a* is positioned relative to the housing 501 only at its home position.

Further, the pin 94 of the print drum 1*a* mates with the hole 89 of the coupling portion, so that the rotation of the main motor 81 can be transferred to the print drum 1*a*. When the main motor 81 rotates clockwise or counterclockwise by a presented amount, the lug 88 of the drum drive plate 87 is displaced relative to the notch 93A of the rear frame 56 via the first drum pulley 84 in FIG. 3. Consequently, the drum unit 100*a* is locked in position and inhibited from being pulled out of the housing 501.

As stated above, the drum units 100*a* and 100*b* can be mounted to or dismounted from the housing 501 only when the print drums 1*a* and 1*b*, respectively, are held at the home positions relative to the housing 501. The coupling portion of the illustrative embodiment may be replaced with a stop mechanism for restricting the removal of the drum units 100*a* and 100*b* from the housing 501 (see, e.g., FIG. 5 of Laid-Open Publication No. 8-39916). Further, use may be made of a meshing mechanism in which drum gears, not shown, respectively mounted on the print drums 1*a* and 1*b* mesh with drive gears, not shown, only when the print drums 1*a* and 1*b* are held at their home positions, and can be released from the drive gears.

A connector, not shown, similar to a connector taught in Laid-Open Publication No. 11-138961 is mounted on the rear wall of the housing 501. A connector, not shown, is mounted on the outer surface of the rear frame 56 of the drum unit 100*a* and connectable to the above connector of the housing 501. The connector of the housing 501 is connected to an external power source and the controller 200 shown in FIG. 9. The connector of the drum unit 100*a* is connected to an encoder sensor (see FIG. 9) and the ink sensing means and ink pump 66*a*. When the drum unit 100*a* is inserted into the housing 501 via the mounting/dismounting means 50*a*, the connector of the drum unit 100*a* is connected to the connector of the housing 501. In this condition, power supply and signal exchange are effected while the presence of the drum unit 100*a* on the housing 501 is electrically detected. This is also true with the other drum unit 100*b*. The connector of the drum unit 100*a* and the connector of the housing 501 respectively constitute a first drum sensor 77 and a second drum sensor 78 (see FIG. 9).

The drum unit 100*a* and 100*b* each include a device, not shown, for fixing, when the drum unit is removed from the housing 501, the home position of the print drum where the damper 5*a* or 5*b* is positioned at the bottom of the print drum. Such a device allows the drum unit to be inserted into the housing 501 in the same position as during removal. The grip 63 includes an unlock lever for mechanically unlocking the drum unit 100*a* from the housing 501 when the operator holds the grip 63. The drum unit 100*a* further includes locking means for mechanically locking the drum unit 100*a* to a locking portion included in the housing 501 when the drum unit 100*a* is fully set on the housing 501. The locking means may have a structure shown in, e.g., FIG. 5 of Laid-Open Publication No. 8-39916. The locking means is combined with the locking structure of the coupling portion for enhancing sure operation and safety.

The drum units 100*a* and 100*b* and mounting/dismounting means 50*a* and 50*b* may be replaced with drum units 10 provided with respective drum stop mechanisms 20 and means for removably supporting them, which are shown in, e.g., FIGS. 1 through 5 of Laid-Open Publication No. 10-109470.

To better understand the illustrative embodiment, why the distance between nearby print drums is made shorter than the circumferential length of each drum with an initial phase difference being provided between the drums will be described with reference to FIGS. 10 through 14.

Figure 14:
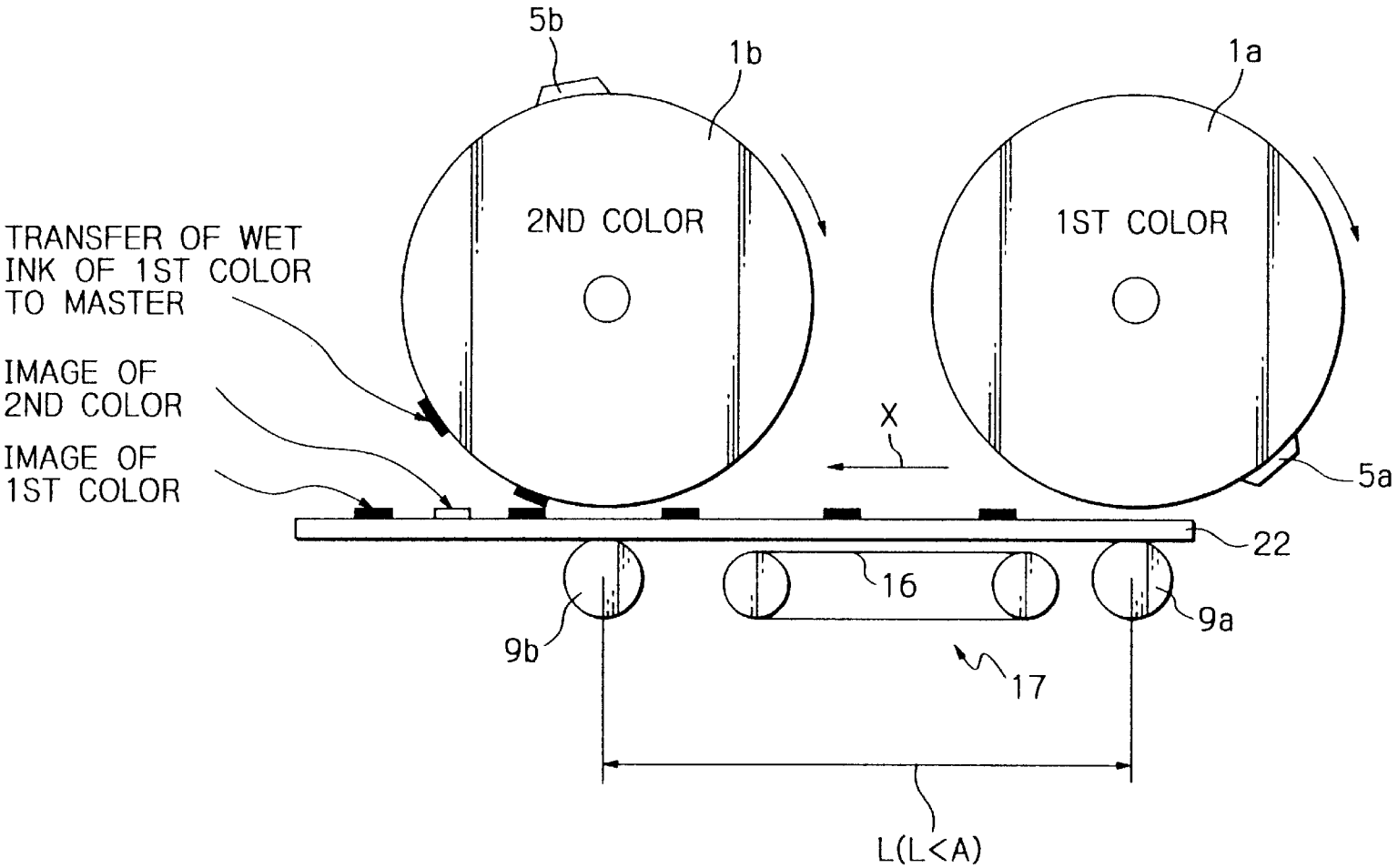
FIG. 14 is a front view showing a positional relation between the print drums included in the illustrative embodiment.

As shown in FIG. 14, assume that the print drums 1*a* and 1*b* each have a circumferential length A, and that the two drums 1*a* and 1*b* are spaced from each other by a distance L. The paper sheet 22 carries the image of the first color represented by black rectangles and the image of the second color represented by outline rectangles. The paper sheet 22 is conveyed by the print drum 1*a* being rotated counterclockwise, while being nipped between the drum 1*a* and the press roller 9*a*. The paper sheet 22 is then conveyed by the intermediate conveying means 17 toward the print drum 1*b* at a speed equal to the peripheral speed of the print drum 1*a*. The prerequisite with such conveyance is that the reference position of the image on the paper sheet 22 be exactly coincident at both of the print drums 1*a* and 1*b*. It follows that the print drum 1*b* must be provided with a delay corresponding to the distance L relative to the print drum 1*a*.

Figure 10:
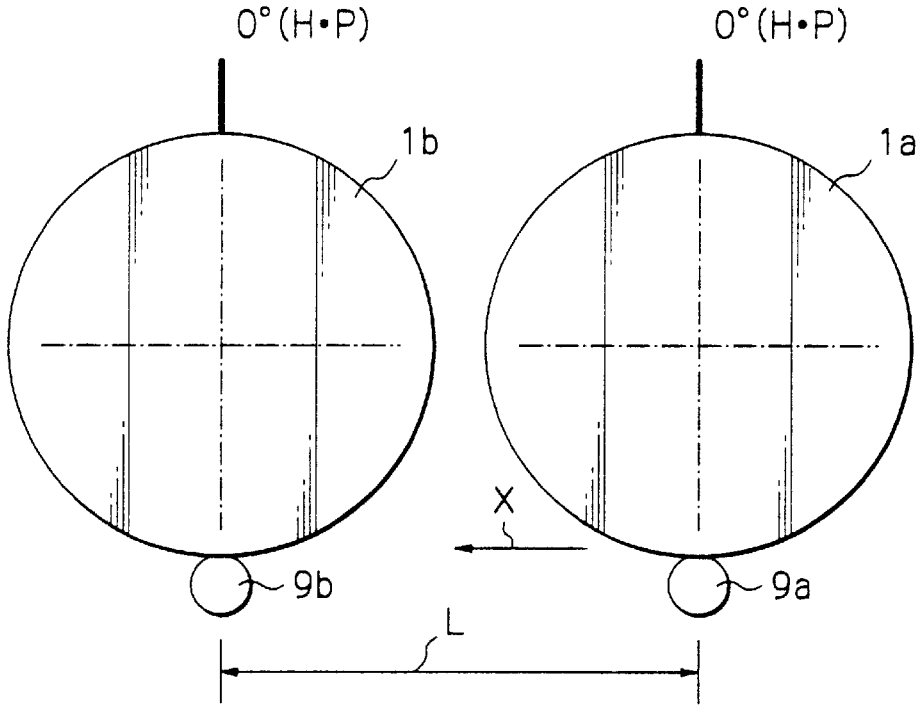
FIGS. 10 and 11 are views for describing an initial phase difference provided between nearby print drums in the illustrative embodiment.
Figure 11:
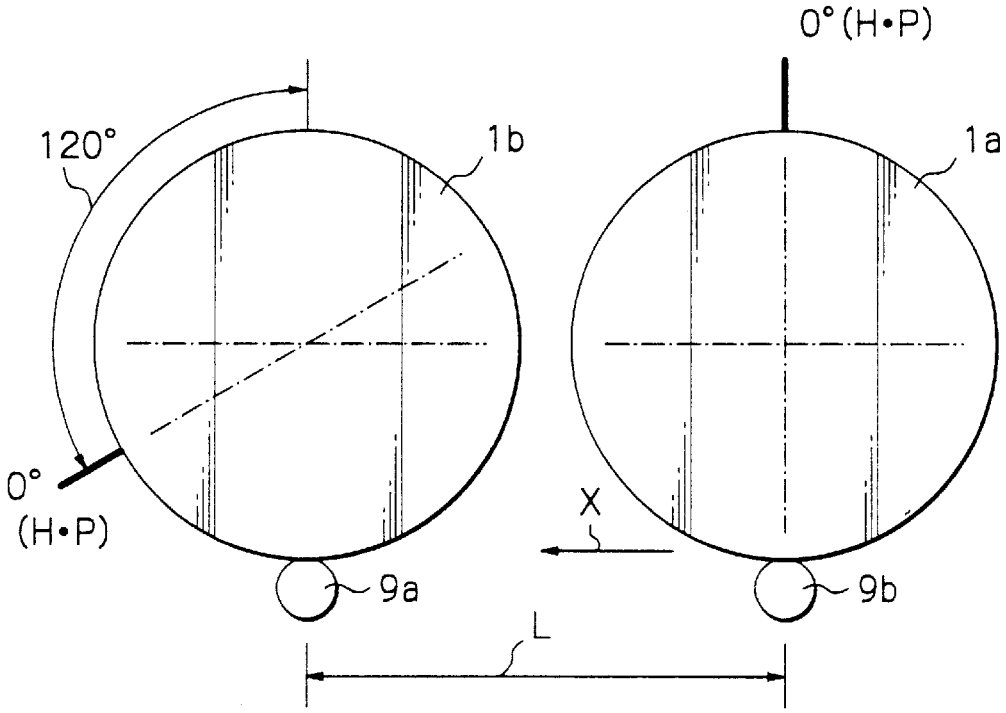

For example, as shown in FIGS. 10 and 11, assume that the home positions of the print drums 1*a* and 1*b* are contrary to the home positions of the illustrative embodiment, but the paper sheet 2 is conveyed in the above-described conditions.

Specifically, assume that the home positions of the print drums 1*a* and 1*b* are set at a reference angle of 0° (mechanical origin) such that the dampers 5*a* and 5*b*, respectively, are positioned on the top. Further, assume that the distance L is not equal to the circumferential length A and is shorter than A for a compact configuration, and that L and A are 100 mm and 300 mm, respectively. Then, the phase difference (delay angle) of the print drum 1*b* relative to the print drum 1*a* is 360×(100/300)=120°.

Figure 12:
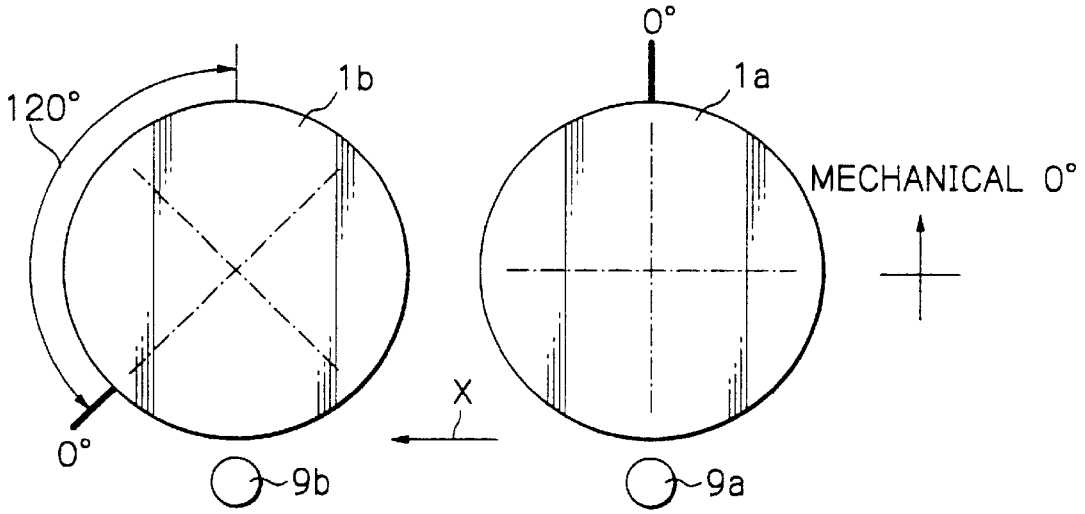
FIG. 12 is a view showing a mount/dismount position assigned to a first drum included in the illustrative embodiment.
Figure 13:
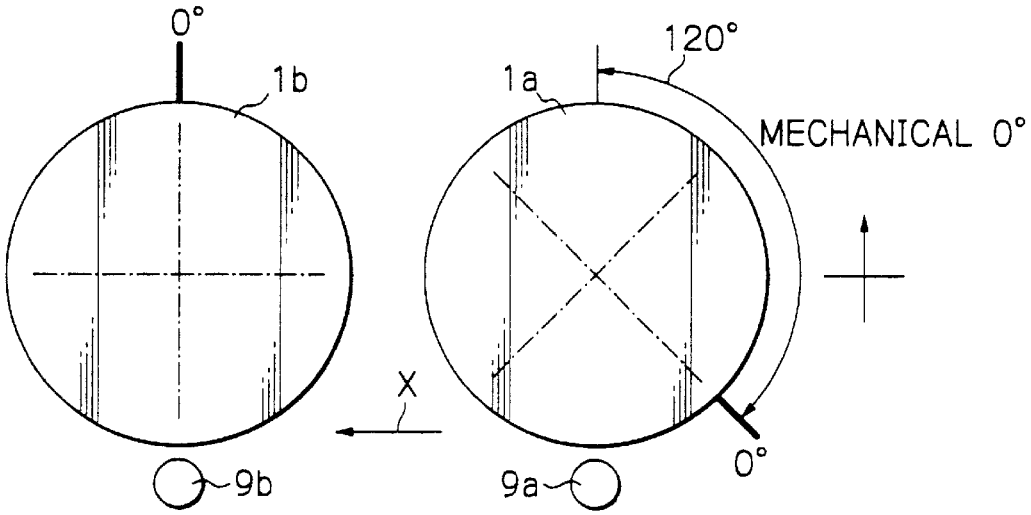
FIG. 13 is a view showing a mount/dismount position assigned to a second drum included in the illustrative embodiment.

A positional relation that allows the print drums 1*a* and 1*b* shown in FIGS. 10 and 11 to be inserted into the printer body will be described with reference to FIGS. 12 and 13. As shown, only when the home positions of the print drums 1*a* and 1*b* (reference angle of 0°) are coincident with the mechanical origin of 0° of the printer body, the former can be mounted to or dismounted from the latter. Stated another way, the print drums 1*a* and 1*b* cannot be mounted or dismounted at the same time if L is not equal to A. In FIG. 12, only the print drum 1*a* coincident with the mechanical origin of 0° can be mounted or dismounted. In FIG. 13, only the print drum 1*b* coincident with the mechanical origin of 0° can be mounted or dismounted because the phase difference (delay angle) of the print drum 1*a* relative to the print drum 1*b* is 120°.

In the illustrative embodiment, L is not equal to A and is shorter than A for a compact configuration while L and A are selected to be 240 mm and 180π (565) mm. Therefore, as shown in FIG. 1, the phase difference between the print drums 1*a* and 1*b* is 153° with respect to the positions of the dampers 5*a* and 5*b*.

Why the above phase difference is selected will be described on the assumption that the masters 33*a* and 33*b* existing on the print drums 1*a* and 1*b*, respectively, have the same size, and that images formed in the masters 33*a* and 33*b* both are solid images. The print drums 1*a* and 1*b* are connected to each other such that they rotate at the same peripheral speed, while the path between the print positions of the print drums 1*a* and 1*b* has a certain length. Obviously, therefore, to transfer the entire contour of the solid image from the print drum 1*b* to the paper sheet 22 over the solid image transferred from the print drum 1*a* without any positional deviation in the direction of paper conveyance X, the print drum 1*b* must be provided with an initial phase difference corresponding to the length of the above path.

It will be seen from the above that the print drums 1*a* and 1*b* cannot be brought to the respective mount/dismount positions at the same time. That is, the print drums 1*a* and 1*b* are brought to the mount/dismount positions by being rotated one by one or successively. This can be done with the simple drum drive means 80 including a single main motor 81, i.e., without resorting to the sophisticated topbottom movement adjusting means taught in Laid-Open Publication No. 11-138961.

The illustrative embodiment selects the distance L not equal to the circumferential length A and shorter than A and includes two print drums 1*a* and 1*b* and two paper egress sensors 74 and 75 respectively neighboring the print drums 1*a* and 1*b*. Of course, the illustrative embodiment is applicable even to a stencil printer including three or more print drums and three or more paper egress sensors respectively assigned thereto.

Reference will be made to FIG. 8 showing a specific configuration of the operation panel 110. As shown, the operation panel 110 includes various keys for allowing the operator to operate the printer 500 and various indicators and displays for displaying the operation statuses of the printer 500 as well as the operator's manipulation. Specifically, a print key 111 starts the paper feed, print and paper discharge procedure when pressed. Numeral keys 112 are available for inputting, e.g., a desired number of prints. A stop key 113 interrupts the paper feed, print and paper discharge procedure when pressed. A first drum unlock key or individual removal setting means 114 makes the drum unit 100*a*, which includes the print drum 1*a* to be removed, removable when pressed. A second drum unlock key or individual removal setting means 115 makes the drum unit 100*b*, which includes the print drum 1*b* to be removed, removable when pressed.

The first drum unlock key 114 plays the role of individual insertion setting means at the same time for making the drum unit 100*a*, which includes the print drum 1*a* to be inserted, insertable when pressed. Likewise, the second drum unlock key 115 plays the role of individual insertion setting means at the same time for making the drum unit 100*b*, which includes the print drum 1*b* to be inserted, insertable when pressed. When the keys 114 and 115 are pressed at the same time, they set up conditions that allow the drum units 100*a* and 100*b* to be successively prepared for removal and, in this sense, serve as successive removal setting means.

A first "Ready" LED 116 and a first "Unready" LED 117 are also arranged on the operation panel 110 and respectively show that the drum unit 100*a* can be mounted or dismounted and that it cannot be done so. A second "Ready" LED 118 and a second "Unready" LED 119 respectively show that the drum unit 100*b* can be mounted or dismounted and that it cannot be done so. An LCD (Liquid Crystal Display) 120 displays whether or not a mounting/dismounting operation is allowed drum unit by drum unit. The first and second "Ready" LEDs 116 and 118 and first and second "Unready" LEDs 117 and 119 constitute ready/unready displaying means for displaying whether or not the drum units 100*a* and 100*b* can be mounted or dismounted. The "Ready" LEDs 116 and 118 may be green LEDs and may be caused to blink or glow by an LED driver. Also, the "Unready LEDs 1117 and 119 may be red LEDs and may be caused to blink or glow by an LED driver.

If desired, only the first and second "Ready" LEDs 116 and 118 may be arranged on the operation panel 110, i.e., the first and second "Unready" LEDs 117 and 119 may be omitted. In such a case, the LEDs 116 and 118 will be caused to blink or glow by an LED driver if the drum units 100*a* and 100*b* can be mounted or dismounted, and will be turned off if otherwise. Further, the LEDs 116 and 118 may be caused to blink while the associated drum units 100*a* and 100*b* are rotating toward the respective mount/dismount positions.

The LCD 120 is connected to an LCD driver and may display the rotation of the drum units 100*a* and 100*b* toward their mount/dismount positions in the form of a picture or characters. Also, the LCD 120 plays the role of informing means for informing, based on the outputs of the first and second paper egress sensors 74 and 75, the operator of the drum unit 100*a* and/or the drum 100*b* where defective paper egress has occurred.

Figure 5:
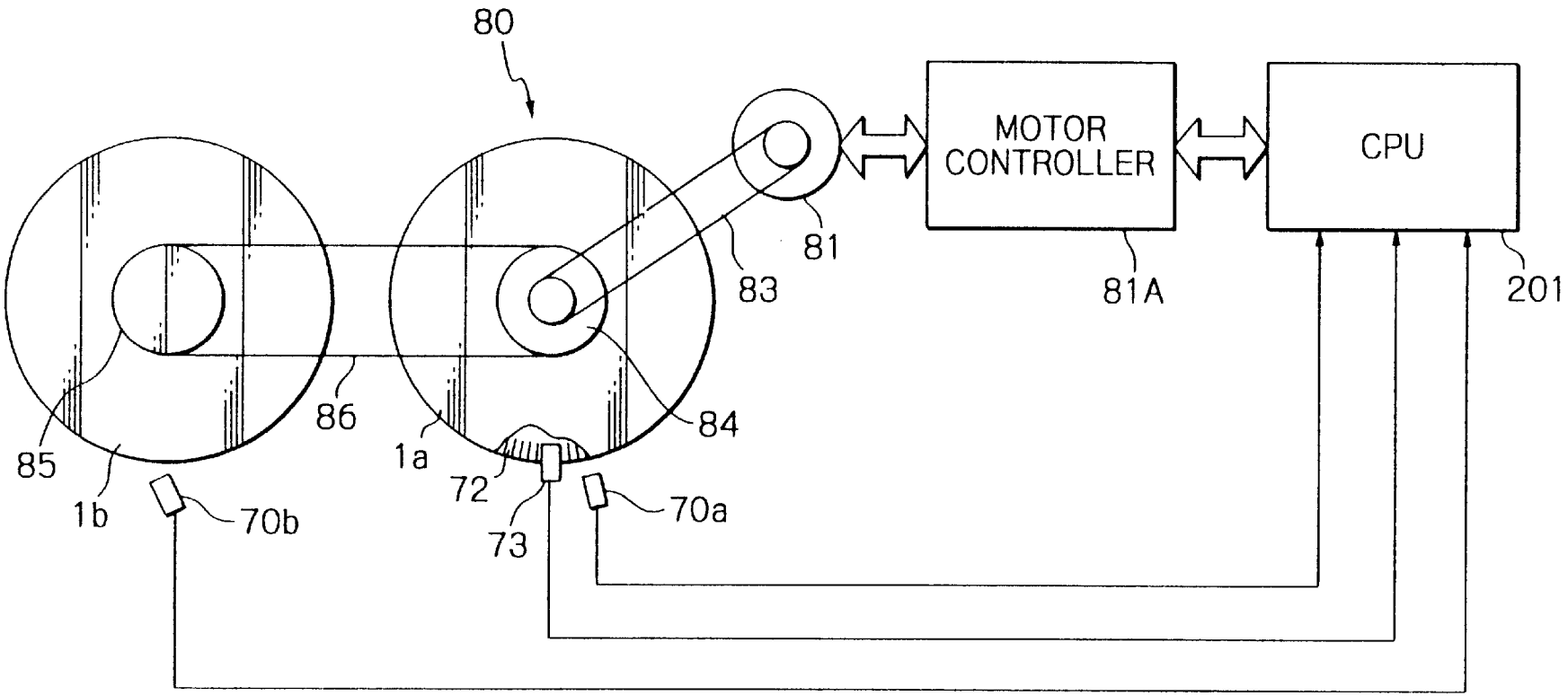
FIG. 5 is a schematic block diagram showing a control arrangement around the drum drive means.

Referring to FIGS. 5, 6A, 6B and 9, a control system including the controller 200 will be described. As shown in FIG. 5, the main motor 81 is connected to a CPU 201, which is included in the controller 200, via a motor controller 81A. The main motor 81 interchanges ON/OFF signals, data signals and command signals with the CPU 201 via the motor controller 81A. Home position sensors 70*a* and 70*b* are located at preselected positions on the housing 501 facing the rear end plates, not shown, of the print drums 1*a* and 1*b*. The home position sensors 70*a* and 70*b* are respectively responsive to the home positions of the print drums 1*a* and 1*b* and implemented by transmission type photosensors similar to photosensors shown in FIG. 6 of Laid-Open Publication No. 11-138961 or FIG. 7 of Laid-Open Publication No. 11-151852.

Screen members, not shown, respectively protrude outward from the rear end plates, not shown, of the print drums 1*a* and 1*b* in such a manner as to selectively meet the home position sensors 70*a* and 70*b*, respectively. The screen plates are configured in the same manner as in FIG. 6 of Laid-Open Publication No. 11-138961 or FIG. 7 of Laid-Open Publication No. 11-151852. In the illustrative embodiment, it is not necessary to sense a master feed position or a master discharge position.

An optical, incremental rotary encoder 72 formed with a number of slits is mounted on the rear end plate of the print drum 1*a*. An encoder sensor 73 is mounted on the rear frame 56 of the drum unit 100*a* and embraces the peripheral portion of the encoder 72. The encoder sensor 73 is implemented by a transmission type photosensor and determines the amount of rotation (rotation angle) of the print drum 1*a*.

The CPU 201 calculates, based on the output signals of the home position sensors 70*a* and 70*b* and encoder sensor 73, the absolute rotation angles of the print drum 1*a* and 1*b* from the home positions (mechanical origins), thereby determining the angular positions of the drums 1*a* and 1*b* and those of the drum drive plates 87. The home position sensors 70*a* and 70*b*, screen members, encoder 72 and encoder sensor 73 constitute angular position sensing means responsive to the angular positions of the print drums 1*a* and 1*b*.

The belts included in the rotation transmitting means of the drum drive means 80 may be replaced with gears if consideration does not have to be given to cost reduction. The DC motor used as the main motor 81 may be replaced with a stepping motor or similar pulse-driven motor, in which case the encoder 73 is omissible. Further, if consideration does not have to be given to the stretch of the belts and other factors effecting the home position sensing accuracy, a single home position sensor may be assigned to either one of the print drums 1*a* and 1*b* because the print drum 1*b* is driven by belt connection.

As shown in FIG. 9, the controller 200 is implemented as a microcomputer including a RAM 202 (Random Access Memory), a ROM 203 (Read Only Memory) 203 and an I/O (Input/Output) port, not shown, in addition to the CPU 201. The CPU 201, RAM 202, ROM 203 and I/O port are interconnected by, e.g., a signal bus. The CPU 201 receives the ON/OFF signals and data signals from the home position sensors 70 and 70*b*, encoder sensor 73, first and second paper egress sensors 74 and 75, first and second drum sensors 77 and 78, power switch 95, and door sensor 504. Also, the CPU 201 receives ON/OFF signals from the various keys of the operation panel 110 including the first and second drum unlock keys 114 and 115.

The CPU 201 sends various command signals to the first and second "Ready" LEDs 116 and 118, first and second "Unready" LEDs 117 and 119, and LCD 120. Further, the CPU 201 sends various command signals to the first and second "Ready" LEDs 96 and 98 and first and second "Unready" LEDs 97 and 99. In addition, the CPU 201 sends various command signals to the main motor 81.

In response to the output of the first or second drum unlock key 114 or 115 and the output of the angular position sensing means associated with the print drum 1*a* or 1*b* to be removed, the CPU 201 (controller 200 hereinafter) controls the main motor 81 such that the print drum 1*a* or 1*b* to be removed is brought to its home position (first function).

In response to the outputs of the paper egress sensors 74 and 75, first or second drum unlock key 114 or 115 and angular position sensing means associated with the print drum 1*a* or 1*b* to be removed, the controller 200 controls the main motor 81 such that the print drum 1*a* or 1*b* to be removed and where defective egress has occurred is brought to its home position (second function).

Assume that after one of the drum units 100*a* and 100*b* has been removed, the other drum unit should also be removed. Then, when the operator opens the door 503, removes the drum unit 100*a* or 100*b*, and again closes the door 503, the door sensor 504 sends its output to the controller 200. In response to the output of the door sensor 504, the output of the drum unlock key 114 or 115 assigned to the drum unit 100*a* or 100*b* to be removed next, and the output of the angular position sensing means assigned to the same drum unit 100*a* or 100*b*, the controller 200 controls the main motor 81 such that the print drum 1*a* or 1*b* of the drum unit to be removed is brought to its home position (third function).

Assume that the operator presses the drum unlock keys 114 and 115 at the same time. Then, in response to the outputs of the keys 114 and 115 and the output of the angular position sensing means assigned to the drum unit 100*a* or 100*b* to be removed, the controller 200 controls the main motor 81 such that the print drum 1*a* or 1*b* of the above drum unit is brought to its home position. Subsequently, in response to the output of the angular position sensing means assigned to the print drum 1*a* or 1*b* of the other drum unit to be removed next, the controller 200 controls the main motor 81 such that the print drum 1*a* or 1*b* of the drum unit to be removed is brought to its home position (fourth function).

Again, assume that the operator presses the drum unlock keys 114 and 115 at the same time. Then, in response to the outputs of the keys 114 and 115, the outputs of the paper egress sensors 74 and 75, and the output of the angular position sensing means assigned to the drum unit 100*a* or 100*b* to be removed, the controller 200 controls the main motor 81 such that the print drum 1*a* or 1*b* of the drum unit 100*a* or 100*b* to be removed and where defective egress has occurred is brought to its home position. Subsequently, in response to the output of the angular position sensing means assigned to the print drum 1*a* or 1*b* of the other drum unit 100*a* or 100*b* to be removed next and where defective egress has occurred, the controller 200 controls the main motor 81 such that the print drum 1*a* or 1*b* of the drum unit to be removed next is brought to its home position (fifth function)

Assume that the operator, intending to remove both of the drum units 100*a* and 100*b*, opens the door 503, removes one of the drum units 100*a* and 100*b*, and again closes the door 503. Then, in response to the resulting output of the door sensor 504 and the output of the angular position sensing means assigned to the print drum 1*a* or 1*b* of the drum unit 100*a* or 100*b* to be removed next, the controller 200 controls the main motor 18 such that the print drum 1*a* or 1*b* of the drum unit to be removed next is brought to its home position (sixth function).

In response to the output of the paper egress sensor 74 or 75 representative of an egress error, the controller 200 controls the LCD 120 in such a manner as to inform the operator of the drum unit 100*a* or 100*b* where the egress error has occurred (seventh function).

In response to the output of the door sensor 504 and the outputs of the paper egress sensors 74 and 75, the controller 200 determines whether or not a printing operation is allowed (eighth function).

The controller 200 controls the LEDs 96 through 99, LEDs 116 through 119 and LCD 120 on the basis of the outputs of the home position sensors 70*a* and 70*b* and the output of the encoder sensor 73 (ninth function).

The controller 200 controls the LEDs 96 through 99, LEDs 116 through 19 and LCD 120 on the basis of the outputs of the drum sensors 77 and 78 (tenth function).

In response to the outputs of the paper egress sensors 74 and 75 and the output of the angular position sensing means assigned to the print drum 1*a* or 1*b* of the drum unit 100*a* or 100*b* to be removed, the controller 200 controls the main motor 81 such that the print drum 1*a* or 1*b* of the drum unit to be removed and where an egress error has occurred is brought to its home position. Subsequently, in response to the outputs of the sensors 74 and 75 and the output of the angular position sensing means assigned to the print drum 1*a* or 1*b* of the other drum unit to be removed next, the controller 200 controls the main motor 81 such that the print drum 1*a* or 1*b* of the same drum unit is brought to its home position (eleventh function).

Assume that the power switch 95 is turned on. Then, in response to the output of the drum unlock key 114 or 115 and the output of the angular position sensing means assigned to the print drum 1*a* or 1*b* of the drum unit 100*a* or 100*b* to be inserted, the controller 200 controls the main motor 81 such that the drum drive plate 87 of the casing 501 assigned to the print drum 1*a* or 1*b* of the above drum unit is brought to its home position (twelfth function).

Again, assume that the power switch 95 is turned on. Then, in response to the output of the drum sensing means assigned to the print drum 1*a* or 1*b* of the drum unit 100*a* or 100*b* to be inserted, the controller 200 controls the main motor 81 such that the drum drive plate 87 assigned to the print drum 1*a* or 1*b* of the above drum unit is brought to its home position. Subsequently, in response to the output of the drum sensing means assigned to the print drum 1*a* or 1*b* of the other drum unit to be mounted next, the controller 200 controls the main motor 81 such that the drum drive plate 87 assigned to the print drum 1*a* or 1*b* of the same drum unit is brought to its home position (thirteenth function).

Assume that neither one of the drum units 100*a* and 100*b* is present on the housing 501 and that the operator inserts one of them into the housing 501. Then, in response to the outputs of the drum sensors 77 and 78, the controller 200 controls the main motor 81 such that the drum drive plate 87 assigned to the print drum 1*a* or 1*b* of the other drum unit 100*a* or 100*b* absent on the housing 501 is brought to its home position (fourteenth function).

The ROM 203 stores data for controlling the main motor 81, LEDs 96 through 99, LEDs 116 through 119 and LCD 120 and programs for executing specific procedures to be described with reference to FIGS. 15 through 20 later. The RAM 202 temporarily stores data signals received from the various sensors. In addition, the RAM 202 stores. rotation priority order for allowing the drum units 100*a* and 100*b* to be continuously mounted to or dismounted from the housing 501. Specifically, if the drum unit 100*a* is provided with priority over the drum unit 100*a,* the drum drive plate 87 assigned to the print drum 1*a* is rotated to its mount/dismount position, and then the drum drive plate 87 assigned to the print drum 1*b* is rotated to its mount/dismount position. If the drum unit 100*b* is provided with priority over the drum unit 100*a,* the rotation occurs in the reverse order.

Before the specific procedures shown in FIGS. 15 through 20, the general sequence of paper feeding step, printing step and paper discharging step will be described. After the used masters 33*a* and 33*b* have been removed from the print drums 1*a* and 1*b,* respectively, new masters 33*a* and 33*b* are wrapped around the print drums 1*a* and 1*b*. The drum units 100*a* and 100*b* respectively loaded with such print drums 1*a* and 1*b* are inserted into the housing 501 (initial condition shown in FIG. 1). Then, the paper feeding step and printing step begin. At this instant, the print drum 1*a* is rotated to its home position where the damper 5*a* is positioned at the bottom. The other print drum 1*a* is rotated to a position where the damper 5*b* takes an obliquely upper rightward position. In this manner, in the illustrative embodiment, a phase difference is initially provided between the print drums 1*a* and 1*b* when the drums 1*a* and 1*b* are present in the housing 501.

The operator turns on the power switch 95, inputs a desired number of prints on the numeral keys 112, and then presses the print key 111. In response, the printing step begins. The paper tray 21 is raised beforehand to a level where the top sheet 22 contacts the pickup roller 23. When the paper feed motor 44 drives the separator roller 24 and pickup roller 23, the rollers 24 and 23 pay out the top sheet 22. At the same time, the separator rollers 24 and 25 and separator plate 26 cooperate to separate the top sheet 22 from the underlying sheets 22. The top paper 22 is therefore conveyed toward the registration rollers 29 and 30 in the direction of paper conveyance X while being guided by the guide plates 27 and 28. The leading edge of the paper sheet 22 abuts against a portion of the registration rollers 29 and 30 just short of the nip and forms a loop along the upper guide plate 28, as stated earlier.

On the start of the printing step, the print drum 1*a* assigned to the first color starts rotating at a preselected printing speed. The ink distributor delivers black ink to the ink well 1*a* between the ink roller 3*a* and the doctor roller 4*a*. The ink uniformly deposits on the ink roller 3*a* while being kneaded by the ink roller 3*a* and doctor roller 4*a* in rotation. When the amount of ink becomes short, as determined by the previously mentioned ink sensing means, the ink distributor replenishes ink to the ink well 1*a*. Rotating in the same direction and at the same speed as the print drum 1*a* in contact with the inner periphery of the drum 1*a,* the ink drum 3*a* applies the ink to the inner periphery of the drum 1*a*.

The registration motor 47 and therefore the registration rollers 29 and 30 are rotated at a preselected timing so as to convey the leading edge of the paper sheet 22 in synchronism with the rotation of the print drum 1*a* loaded with the master 33*a*. The leading edge of the paper sheet 22 therefore arrives at the gap between the print drum 1*a* and the press roller 9*a* such that it meets the leading edge of the image formed in the master 33*a*. At this time, the press roller 9*a* is raised toward the print drum 1*a* until it has been pressed against the master 33*a*. As a result, the master 33*a* closely adheres to the print drum 1*a* due to the viscosity of the ink penetrated the porous portion of the drum 1*a*. The ink further penetrates the perforation pattern of the master 33*a*. Consequently, the ink is transferred from the print drum 1*a* to the paper sheet 22, forming a black image on the paper sheet 22.

When the leading edge of the paper sheet 22 with the black image approaches the edge of the air knife 7*a,* the air knife 7*a* is rotated about the shaft 8*a* toward the print drum 1*a* in synchronism with the rotation of the drum 1*a*. A jet of air sent from the edge of the air knife 7*a* peels off the leading edge of the paper sheet 22 from the print drum 1*a*. The intermediate conveying device 17 conveys the paper sheet 22 separated from the print drum 1*a* to the downstream side in the direction of paper conveyance X. Specifically, the belt 16, turning counter clockwise as indicated by an arrow in FIG. 1, conveys the paper sheet 22 toward the next pressing device 32*b* while easily retaining it thereon by suction effected by the fan 18.

The belt 16 conveys the paper sheet 22 at a speed (linear velocity) equal to or higher than the linear velocity or peripheral speed of the print drum 1*a*. However, because the upstream portion of the paper sheet 22 is still nipped between the print drum 1*a* and the press roller 9*a*, the paper sheet 22 moves to the left at a speed equal to the peripheral speed of the drum 1*a*, as stated earlier. The paper sheet 22 is therefore conveyed with leftward tension acting thereon. In a more strict sense, the belt 16 moves at a higher speed than the paper sheet 22, so that the belt 16 and paper sheet 22 slip on each other.

At this instant, the print drum 1*b* assigned to the second color starts a printing operation in synchronism with the print drum 1*a*, i.e., starts rotating at a printing speed. The ink roller 3*b*, contacting the inner periphery of the ink drum 1*b*, feeds magenta ink to the drum 1*b* while rotating at the same speed as the print drum 1*b*. The initial phase difference is set between the print drums 1*a* and 1*b*, as stated earlier.

The leading edge of the paper sheet 22 arrives at the gap between the print drum 1*b* and the press roller 9*b* at a preselected timing synchronous to the rotation of the drum 1*b* while being pulled by the belt 16 in the direction of movement. Then, the press roller 9*b* is raised toward the print drum 1*b* and pressed against the master 33*b* existing on the drum 1*b* due to the action of the tension spring 13*b*. As a result, the master 33*b* closely adheres to the print drum 1*b* due to the viscosity of the ink penetrated the porous portion of the drum 1*b*. The ink further penetrates the perforation pattern of the master 33*b*. Consequently, the ink is transferred from the print drum 1*b* to the paper sheet 22, forming a magenta image on the paper sheet 22 over the black image existing on the paper sheet 22.

While the press roller 9*b* is released from the print drum 1*b* during printing so as not to interfere with the damper 5*b* protruding from the drum 1*b*, it is pressed against the drum 1*b* before the leading edge of the paper sheet 22 arrives at the gap between the roller 9*b* and the drum 1*b*.

When the leading edge of the paper sheet 22 with the bicolor image, i.e., black-and-magenta image approaches the edge of the air knife 7*b*, the air knife 7*b* is rotated about the shaft 8*b* toward the print drum 1*b* in synchronism with the rotation of the drum 1*b*. A jet of air sent from the edge of the air knife 7*b* peels off the leading edge of the paper sheet 22 from the print drum 1*b*. The paper discharging device 35 conveys the paper sheet 22 separated from the print drum 1*b* to the print tray 37 in the direction of paper conveyance X.

Air sent from the blast fan 34 hits against the surface of the paper sheet or print 22 from a position above and leftward of the air knife 7*b*. This air not only prevents the paper sheet 22 from rising above the belt 40, but also promotes the drying of the ink existing on the paper sheet 22. The jump board 40A causes the center portion of the paper sheet 22 to deform in the form of a letter U, i.e., provides the paper sheet 22 with an adequate degree of stiffness, so that the consecutive paper sheets 22 can be neatly stacked on the print tray 37.

The paper sheet 22 peeled off by the air knife 7*b* is retained on the belt 40 by the suction fan 36 while being prevented from rising above the belt 40 by the blast fan 34. The belt 40, turning counterclockwise, conveys the paper sheet 22 toward the print tray 37. As a result, the paper sheet 22 is neatly laid on the print tray 37 via the jump board 40A as a trial print. The press rollers 1*a* and 1*b* are retracted away from the print drums 1*a* and 1*b*, respectively, to their initial positions or stand-by positions shown in FIG. 1.

Assume that the operator, looking at the trial print, determines that the image should be adjusted in position in the direction of paper conveyance X. Then, the operator may adjust the position of the image via top-bottom movement adjusting means 212 taught in Laid-Open Publication No. 11-138961 mentioned earlier. If the trial print is acceptable, the operator inputs a desired number of prints on the numeral keys 112 and then presses the print key 111. In response, the previously described paper feed, print and paper discharge procedure is repeated a number of times corresponding to the desired number of prints.

First Specific Operation

Assume that the paper sheet 22 adheres to the master 22*a* or 22*b* due to the viscosity of the ink too closely to be peeled off by the air knife 7*a* or 7*b* or a conventional peeler and rolls up, or that the paper sheet 22 jams the transport path around the print drum 1*a* or 1*b* or between the print drums 1*a* and 1*b*. Then, one or both of the drum units 100*a* and 100*b* must be successively removed from the housing 501. A first specific operation to be described with reference to FIG. 15 relates to a manual error removal mode for allowing the operator to perform the above operation.

Figure 6A:
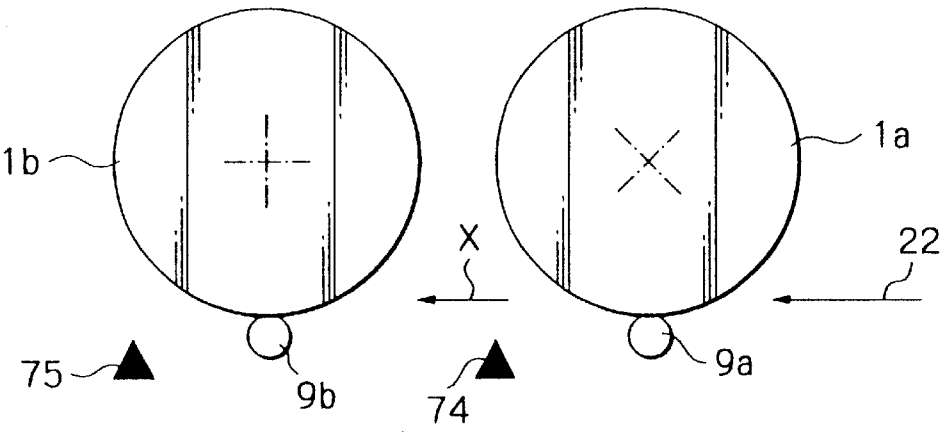
FIG. 6A is a front view schematically showing paper egress sensors included in the illustrative embodiment.
Figure 6B:
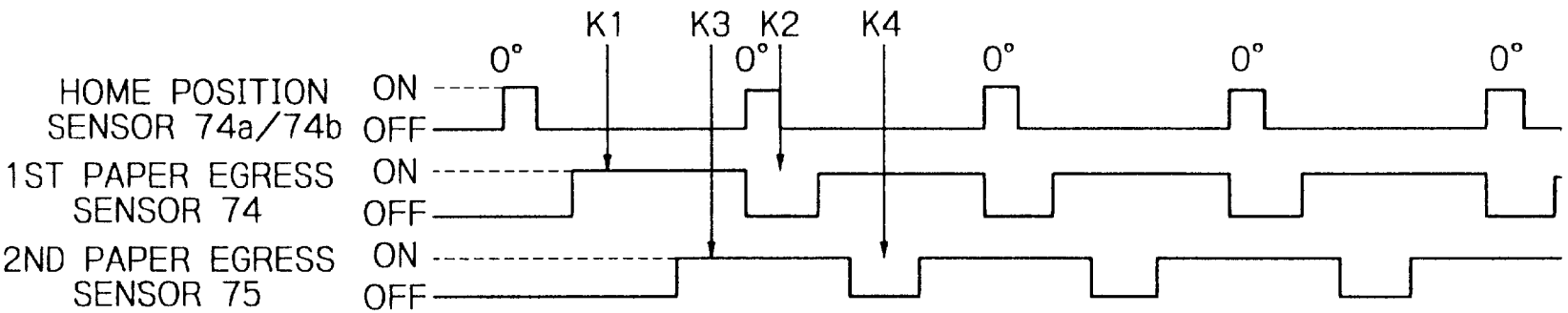
FIG. 6B is a timing chart representative of the operation of the paper egress sensors.

First, how the events including the roll-up and egress error. of the paper sheet 22 are detected will be described with reference to FIGS. 6A and 6B.

(1) Assume that the first paper egress sensor 74 does not sense the paper sheet 22, i.e., it remains in an OFF state even when the print drum 1*a* rotates to a given angle K1 after the start of conveyance of the paper sheet 22. Then, the paper sheet 22 has rolled up and is staying around the print drum 1*a*. If the sensor 74 turns on when the print drum 1*a* reaches the angle K1, the paper sheet 22 is being conveyed in the expected manner.

(2) Assume that the first paper egress sensor 74 remains in an ON state even when the print drum 1*a* further rotates to a given angle K2, an egress error has occurred, and the paper sheet 22 is again staying around the print drum 1*a*. If the sensor 74 turns off when the print drum 1*a* reaches the angle K2, the paper sheet 22 is being conveyed in the expected manner.

(3) If the second egress sensor 75 does not sense the paper sheet 22, i.e., it remains in an OFF state when the print drum 1*b* rotates to a given angle K3, the paper sheet 22 has rolled up and is staying around the print drum 1*b*.

(4) If the second egress sensor 75 remains in an ON state even when the print drum 1*b* further rotates to a given angle K4, an egress error has occurred, and the paper sheet 22 is staying around the print drum 1*b*.

In the first specific operation relating to the manual error removal mode, the previously described second, third and seventh to tenth functions of the controller 200 are used.

Figure 15:
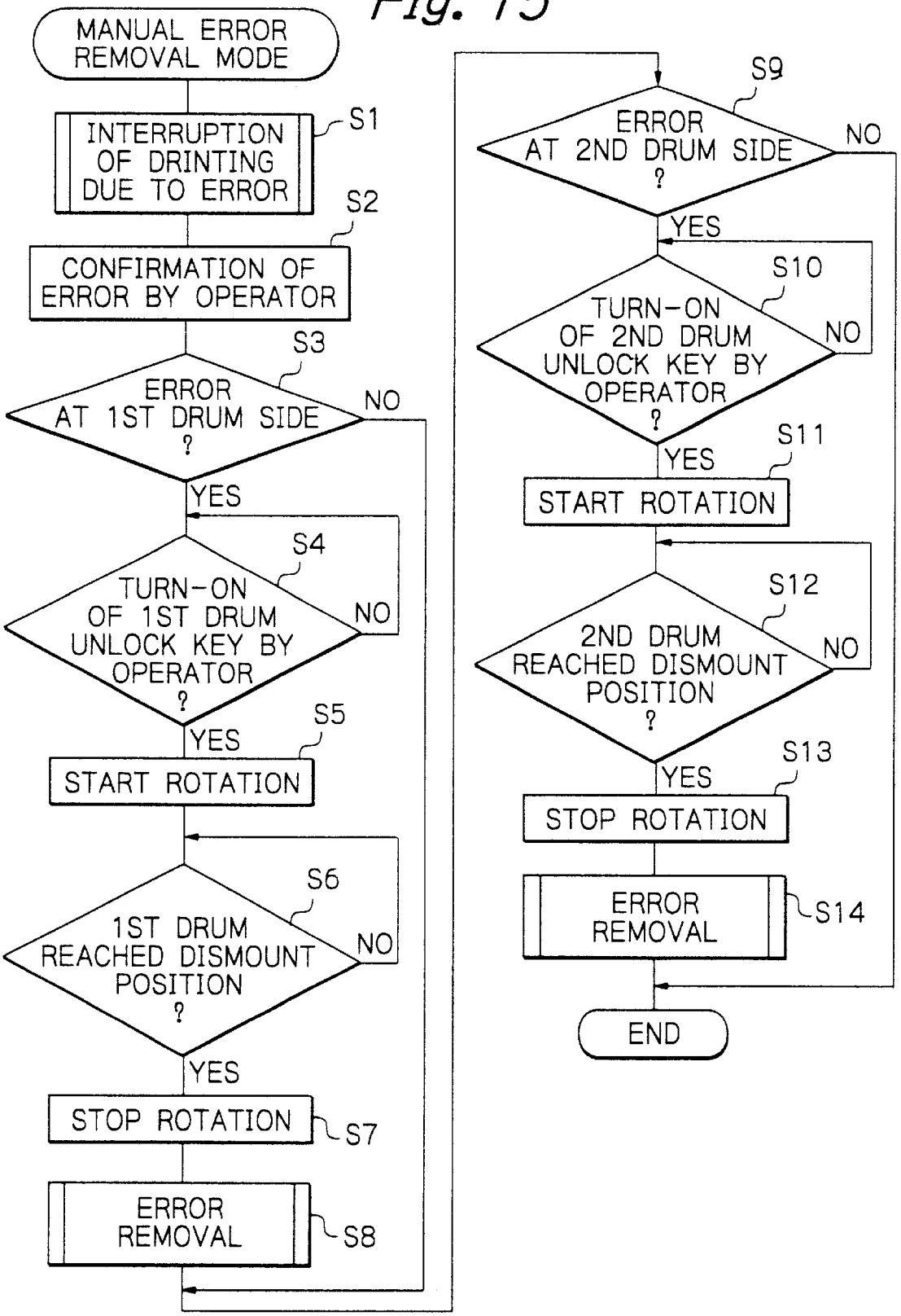
FIGS. 15 through 20 are flowcharts each demonstrating a particular specific operation of the illustrative embodiment.

As shown in FIG. 15, assume that the controller 200 determines, based on the outputs of the first and second paper egress sensors 74 and 75, that any one of the above events (1) through (4) has occurred at the beginning of printing or during printing. Then, the controller 200 interrupts the printing procedure (step S1). The controller 200 then deenergizes the main motor 81 when the drum unit 100*a* or 100*b* reaches a preselected phase (in the illustrative embodiment, the home position of the drum unit 100*a* or 100*b*). At the same time, the controller 200 displays an error message on the LCD 120.

Referencing information appearing on the LCD 120, the operator sees a location where the roll-up or the defective egress of the paper sheet 22 has occurred (step S2). The operator determines whether or not the error has occurred at the print drum 1*a* side (step S3). If the answer of the step S3 is positive (YES), the operator turns on the first drum unlock key 114 (YES, step S4). In response, the controller 200 drives the main motor 81 with the result that the print drum 1*a* starts rotating via the rotation transmitting means (step S5). At this instant, the first "Ready" LED 116 blinks in green while the second "Unready" LED 119 glows in red, urging the operator to wait until the end of rotation of the print drum 1*a*.

Subsequently, the controller 200 controls, based on the outputs of the home position sensor 70*a* and encoder sensor 73, the main motor 81 such that the print drum 1*a* reaches its home position (dismount position). When the print drum 1*a* reaches its home position (YES, step S6), the controller 200 stops driving the main motor 81 and thereby stops the print drum 1*a* at the home position (step S7). At the same time, the first "Ready" LED 116 glows in green.

The step S7 is followed by a step S8 for urging the operator to remove the error by hand. Specifically, watching the first "Ready" LED 116 glowing in green, the operator sees that the print drum 1*a* is located at the home position or dismount position. The operator then opens the door 503 in order to pull out the drum unit 100*a*. In response to the resulting output of the door sensor 504, the controller 200 causes the first "Ready" LED 96 to glow in green and causes the second "Unready" LED 99 to glow in red. The operator sees such statuses of the LEDs 96 and 99 and then pulls out the drum unit 100*a*.

Specifically, the operator holds the grip 63 and pulls the drum unit 100*a* out of the housing 501 via the opening 501*a* and the mounting/dismounting means 50*a*. At this instant, the unlock lever or the stop mechanism interlocked to the grip 63 is operated. The operator removes the paper sheet 22 jamming the path around the print drum 1*a* and again closes the door 503. In response, the controller 200 causes both of the first and second "Unready" LEDs 117 and 119 to glow in red. At the same time, the controller 200 determines whether or not a printing operation is allowed on the basis of the outputs of the door sensor 504 and first paper egress sensor 74. The removal of the drum unit 100*b* is effected in exactly the same manner as the removal of the drum unit 100*b* and will not be described specifically.

If the answer of the step S3 is negative (NO) or after the step S8, the controller 200 determines whether or not the error has occurred at the print drum 1*b* side (step S9). If the answer of the step S9 is YES and if the operator presses the second drum unlock key 115 (YES, step S10), the controller 200 drives the main motor 81 and thereby starts rotating the print drum 1*b* via the rotation transmitting means (step S11). At this instant, the controller 200 causes the second "Ready" LED 118 on the operation panel 110 to blink in green while causing the first "Ready" LED 116 to turn off. This informs the operator of the fact that neither the drum unit 100*a* nor the drum unit 100*b* can be mounted or dismounted, and urges the operator to wait until the end of rotation of the print drum 1*b*.

Subsequently, the controller 200 drives, based on the outputs of the home position sensor 70*b* and encoder sensor 73, the main motor 81 in order to bring the print drum 1*b* to its home position or dismount position. When the print drum 1*b* reaches the home position (YES, step S12), the controller 200 stops driving the main motor 81 and thereby stops the print drum 1*b* at the home position (step S13). At the same time, the controller 200 causes the second "Ready" LED 118 on the operation panel 118 to glow in green.

The step S13 is followed by a step S14 for manual error removal assigned to the print drum 1*b* side. Specifically, watching the second "Ready" LED 118 on the operation panel 110 glowing in green, the operator sees that the print drum 1*b* is located at the home position or dismount position. The operator then opens the door 503 in order to pull out the drum unit 100*b*. In response to the resulting output of the door sensor 504, the controller 200 causes the second "Ready" LED 98 to glow in green and causes the first "Unready" LED 97 to glow in red. The operator sees such statuses of the LEDs 98 and 97 and then pulls out the drum unit 100*b*.

The operator removes the paper sheet 22 jamming the path around the print drum 1*b* and again closes the door 503. In response, the controller 200 causes both of the first and second "Unready" LEDs 117 and 119 to glow in red. At the same time, the controller 200 determines whether or not a printing operation is allowed on the basis of the outputs of the door sensor 504 and second paper egress sensor 75.

The drum units 100*a* and 100*b* each are inserted into the housing 501 in the same manner as will be described in relation to a third specific operation.

Second Specific Operation

One or both of the drum units 100*a* and 100*b* are sometimes successively removed from the housing 501 due to the same errors as in the first specific operation. A second specific operation to be described with reference to FIG. 16 relates to an automatic error removal mode for successively removing the drum units 100*a* and 100*b*. The second specific operation mainly uses the previously described seventh to eleventh functions available with the controller 200.

Figure 16:
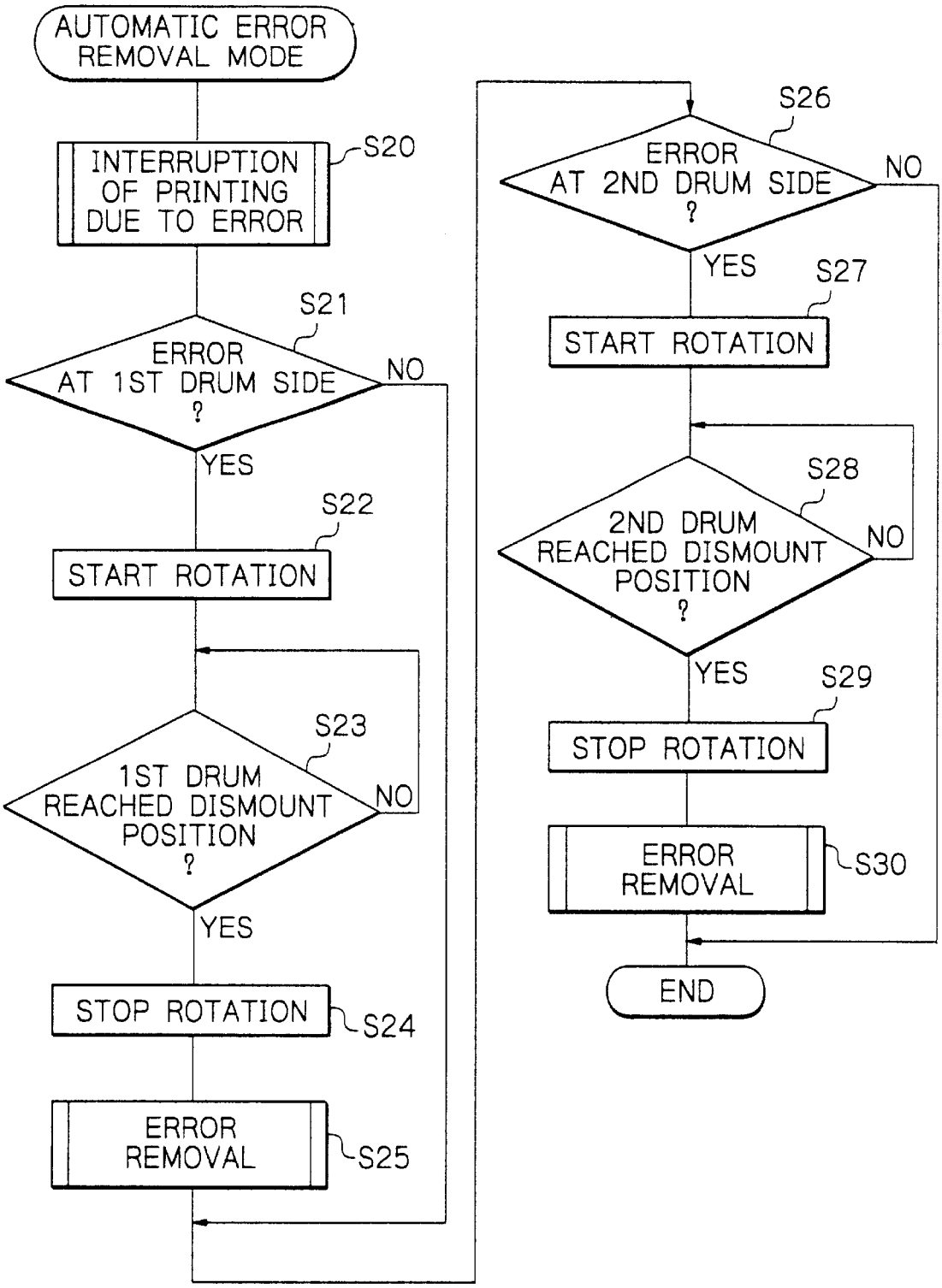

As shown in FIG. 16, assume that the controller 200 determines that any one of the events (1) through (4) has occurred at the beginning of printing or during printing. Then, the controller 200 interrupts the printing procedure (step S20). Subsequently, the controller 200 determines whether or not the error has occurred at the print drum side 1*a* (step S21). If the answer of the step S21 is YES, the controller 200 drives the main motor 81 (step S22).

After the step S22, the controller 200 controls, based on the outputs of the home position sensor 70*a* and encoder sensor 73, the main motor 81 such that the print drum 1*a* reaches its home position (dismount position). When the print drum 1*a* reaches its home position (YES, step S23), the controller 200 stops driving the main motor 81 and thereby stops the print drum 1*a* at the home position (step S24). At the same time, the controller 200 causes the first "Ready" LED 116 to glow in green and displays an error message on the LCD 120.

The step S24 is followed by a step S25 for manual error removal as in the first specific operation. Specifically, the operator pulls the drum unit 100*a* out of the housing 501 and then closes the door 503. In response to the resulting output of the door sensor 504, the controller 200 executes a step S26 and successive steps.

In the step S26, the controller determines whether or not an error has occurred at the second print drum 1*b* side. If the answer of the step S26 is YES, the controller 200 drives the main motor 81 to thereby start rotating the print drum 1*b* via the rotation transmitting means (step S27). At this instant, the controller 200 causes the second "Ready" LED 118 on the operation panel 110 to blink in green while causing the first "Ready" LED 116 to turn off and causing the first "Unready" LED 117 to glow. This informs the operator of the fact that neither the drum unit 100*a* nor the drum unit 100*b* can be mounted or dismounted, and urges the operator to wait until the end of rotation of the print drum 1*b*. If the answer of the step S21 is NO, the step S21 is also followed by the step S26.

Subsequently, the controller 200 drives, based on the outputs of the home position sensor 70*b* and encoder sensor 73, the main motor 81 in order to bring the print drum 1*b* to its home position or dismount position. When the print drum 1*b* reaches the home position (YES, step S28), the controller 200 stops driving the main motor 81 and thereby stops the print drum 1*b* at the home position (step S29). At the same time, the controller 200 causes the second "Ready" LED 118 on the operation panel 118 to glow in green and displays an error message on the LCD 120.

The step S29 is followed by a step S30 for manual error removal assigned to the print drum 1*b* side as in the first specific operation.

The drum units 100*a* and 100*b* each are inserted into the housing 501 in the same manner as will be described in relation to the third specific operation.

Third Specific Operation

The drum units 100*a* and 100*b* are sometimes successively dismounted from the housing 501 in order to, e.g., replace the colors of ink or the masters 33*a* and 33*b* or for a cleaning purpose. A third specific operation to be described with reference to FIG. 17 relates to a manual successive removal mode for allowing the operator to successively remove the drum units 100*a* and 100*b* from the housing 501. The third specific operation mainly uses the first, third and eighth to tenth functions of the controller 200.

Figure 17:
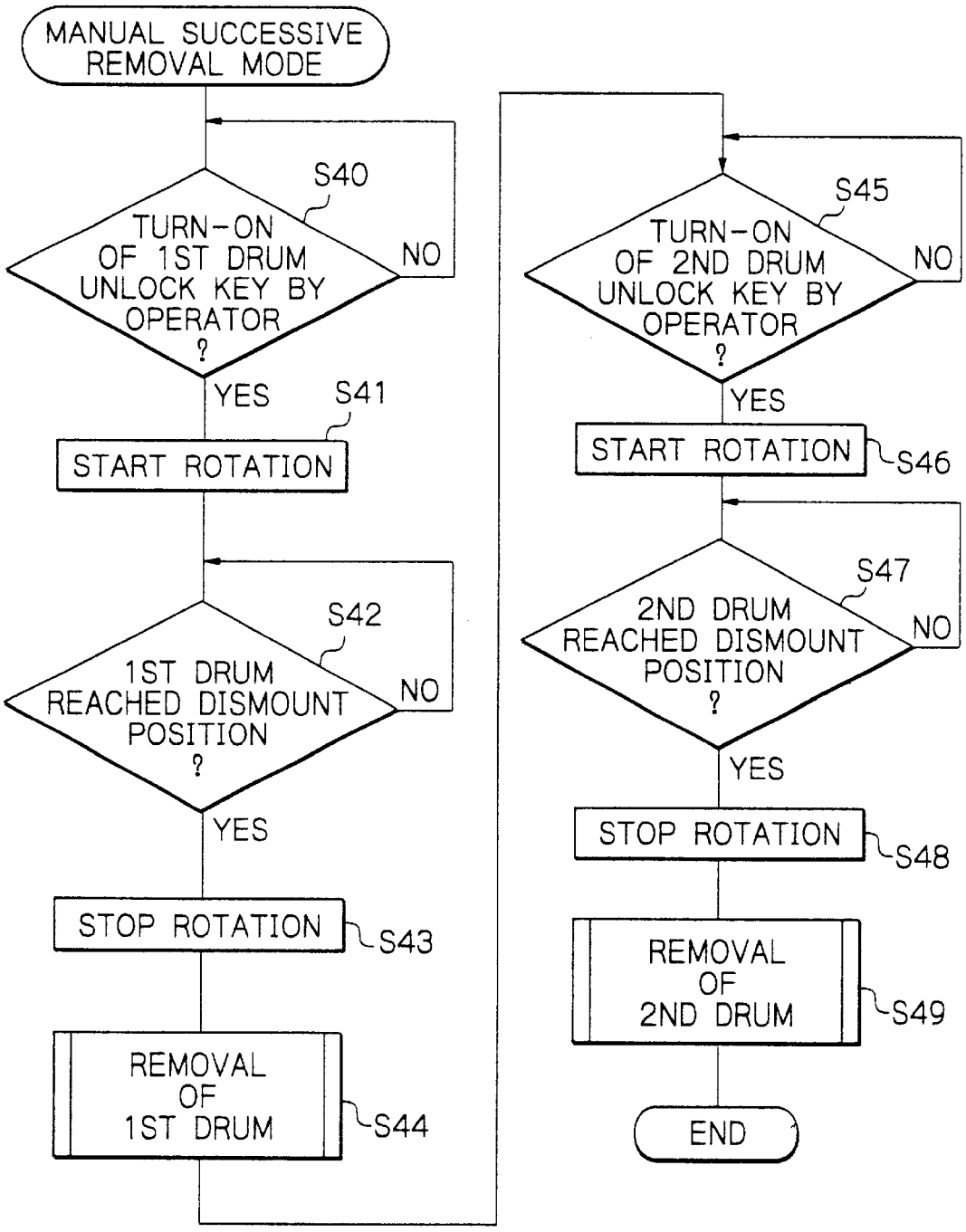

As shown in FIG. 17, when the operator presses the first drum unlock key 114 (YES, step S40), the controller 200 drives the main motor 81 and thereby rotates the print drum 1*a* via the rotation transmitting means (step S41). At this instant, the controller causes the first "Ready" LED 116 to blink in green and causes the second "Unready" LED 119 to glow in red. This informs the operator of the fact that neither the drum unit 100*a* or the drum unit 100*b* can be mounted or dismounted, and urges the operator to wait until the end of rotation of the print drum 1*a*.

Subsequently, the controller 200 controls, based on the outputs of the home position sensor 70*a* and encoder sensor 73, the main motor 81 such that the print drum 1*a* reaches its home position or dismount position. When the print drum 1*a* reaches the home position (YES, step S42), the controller 200 stops driving the main motor 81 to thereby stop the print drum 1*a* at the home position (step S43). At the same time, the controller 200 causes the first "Ready" LED 116 on the operation panel 110 to glow in green.

The step S43 is followed by a step S44. In the step S44, the operator sees the "Ready" LED 116 glowing in green and then opens the door 503 in order to pull the drum unit 100*a* out of the housing 501. In response to the resulting output of the door sensor 504, the controller 200 causes the first "Ready" LED 96 to glow in green while causing the second "Unready" LED 99 to glow in red. Watching such statuses of the LEDs 96 and 99, the operator pulls out the print drum 100*a*.

After the print drum 1*a* has been stopped at the home position, the operator pulls the drum unit 100*a* out of the housing 501 as in the first specific operation, replaces the ink of the print drum 1*a,* replaces the master 33*a* or performs cleaning, and again closes the door 503. The removal of the drum unit 100*b* from the housing 501 is effected in the same manner as the removal of the drum unit 100*a* and will not be described specifically.

Subsequently, when the operator presses the second drum unlock key 15 (YES, step S45), the controller 200 drives the main motor 81 and thereby starts rotating the print drum 1*b* via the rotation transmitting means (step S46). At this instant, the controller 200 causes the second "Ready" LED 119 on the operation panel 110 to blink in green, causes the first "Ready" LED 116 to turn off, and causes the first "Unready" LED 117 to glow. This informs the operator of the fact that neither the drum unit 100*a* not he drum unit 100*b* can be mounted or dismounted, urging the operator to wait until the end of rotation of the print drum 1*b*.

In a step S47 following the step S46, the controller 200 controls, based on the outputs of the home position sensors 70*b* and encoder 73, the main motor 81 in order to bring the print drum 1*b* to its home position or dismount position. When the print drum 1*b* reaches its dismount position (YES, step S47), the controller 200 stops driving the main motor 81 and thereby stops the print drum at the home position (step S48). At this instant, the controller 200 causes the second "Ready" LED 118 on the operation panel 110 to glow in green.

Subsequently, in a step S49, the operator sees the second "Ready" LED 110 glowing in green and then opens the door 503 in order to remove the drum unit 100*b*. In response to the resulting output of the door sensor 504, the controller 200 causes the second "Ready" LED 98 to glow in green and causes the first "Unready" LED 97 to glow in red. Watching such statuses of the LEDs 98 and 97, the operator pulls the drum unit 100*b* out of the housing 501. The operator then performs the replacement of the ink of the print drum 1*b* or the master 33*b* or cleaning and again closes the door 503.

How the drum units 100*a* and 100*b* are inserted into the housing 501 will be described hereinafter. For the mounting operation, use is mainly made of the ninth, tenth and fourteen functions available with the controller 200.

For example, assume that the operator replaces the masters 33*a* and 33*b* of the drum units 100*a* and 100*b* and then inserts the drum unit 100*b* into the housing 501. Then, because the operator pulled out the drum unit 100*b* after the drum unit 100*a* at the time of removal, the second "Ready" LED 98 and first "Unready" LED 97 on the housing 501 are glowing in green and red, respectively. Also, he second "Ready" LED 118 and first "Unready" LED 117 on the operation panel 110 are glowing in green and red, respectively. This shows the operator that the drum drive plate 87 of the coupling portion assigned to the print drum 1*b* is held in its home position (dismount position or mount position), allowing the print rum 100*b* to be inserted into the housing 501.

When the operator inserts the drum unit 100*b* into the housing 501 via the opening 501 and mounting/dismounting means 50*b,* the drum unit 100*b* can be easily received in the housing 501 and set because of the home position of the drum drive plate 87.

Subsequently, the operator closes the door 503. At this instant, the output of the second drum sensor 78 is indicative of the presence of the drum unit 100*b*. In response to this output of the second drum sensor 78, the output of the door sensor 504 and the outputs of the home position sensor 70*b* and encoder sensor 73, the controller 200 drives the main motor 81 until the drum drive plate 87 of the coupling portion assigned to the other drum unit 100*a* reaches its home position. The controller 200 then causes the first "Ready" LED 116 on the operation panel to glow in green.

Seeing the first "Ready" LED 116 glowing in green on the operation panel 110, the operator opens the door 503 in order to insert the drum unit 100*a*. In response to the resulting output of the door sensor 504, the controller 200 causes the first "Ready" LED 96 and second "Unready" LED 99 to glow in green and red, respectively, urging the operator to insert the drum unit 100*a*.

When the operator inserts the drum unit 100*a* into the housing 501 via the opening 501*a* and mounting/dismounting means 50*a*, the drum unit 100*a* can be easily received and set because of the home position of the drum drive plate 87 assigned to the print drum 1*a*. When the operator closes the door 503, the controller 200 determines, in response to the resulting output of the door sensor 504 and the outputs of the drum sensors 77 and 78, that the printer is capable of operating.

Alternatively, the operator may first press the first drum unlock key 114 in order to insert the drum unit 100*a* before the drum unit 100*b*. In such a case, the controller 200 brings the drum drive plate 87 assigned to the print drum 1*a* to its home position. Thereafter, when the operator closes the door 503, the automatic mode operation occurs in substantially the same manner as described above. Specifically, the controller 200 automatically brings the drum drive plate 87 assigned to the print drum 1*b* to the home position, allowing the operator to insert the drum unit 100*b*.

Fourth Specific Operation

To replace the ink of the print drums 1*a* and 1*b*, to replace the masters 33*a* and 33*b* or to perform cleaning, the operator sometimes intends to successively remove the drum units 100*a* and 100*b* from the housing 501. A fourth specific operation to be described with reference to FIG. 18 relates to an automatic successive removal mode for effecting the above operation. The fourth specific operation mainly uses the fourth, sixth and eighth to tenth functions of the controller 200.

Figure 18:
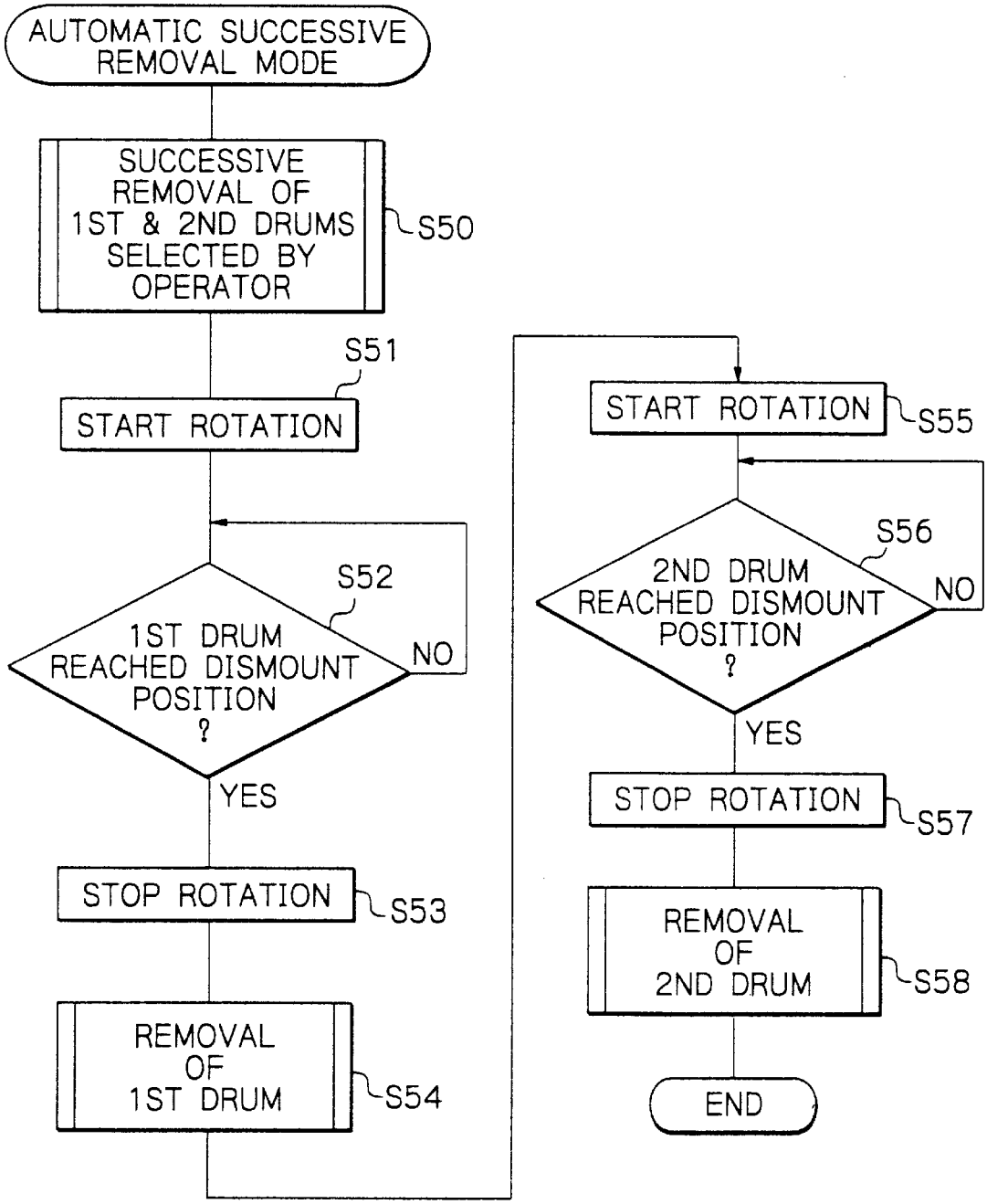

As shown in FIG. 18, the operator presses the first and second drum unlock keys 114 and 115 at the same time for selecting successive drum removal (step S50). At this instant, an automatic successive removal signal is generated to set up an automatic mode. The automatic successive removal signal is sent to the controller 200. In response, the controller 200 drives the main motor 81 and thereby starts rotating the print drum 1*a* via the rotation transmitting means (step S51). At the same time, the controller 200 causes the first "Ready" LED 116 and second "Unready" LED 119 on the operation panel to blink in green and to glow in red, respectively. This shows the operator that neither the drum unit 100*a* nor the drum 100*b* can be mounted or dismounted, urging the operator to wait until the end of rotation of the print drum 1*a*.

Subsequently, the controller 200 controls, based on the outputs of the home position sensor 70*a* and encoder sensor 73, the main motor 81 in such a manner as to bring the print drum 1*a* to its home position or dismount position. When the print drum 1*a* reaches the home position (YES, step S52), the controller 200 stops driving the main motor 81 and thereby stops the print drum 1*a* at the home position (step S53). At the same time, the controller 200 causes the first "Ready" LED 116 to glow in green. In this condition, the operator pulls out the print drum 100*a* in the same manner as in the step S44 of the third specific operation (step S54).

After the step S54, the controller 200 drives the main motor 81 and thereby starts driving the print drum 1*b* via the rotation transmitting means (step S55). At the same time, the controller 200 causes the second "Ready" LED 118 on the operation panel 110 to blink in green while causing the first "Unready" LED 117 to glow. This informs the operator of the fact that neither the drum unit 100*a* nor the drum unit 100*b* can be mounted or dismounted, urging the operator to wait until the end of rotation of the print drum 1*b*.

Subsequently, the controller 200 controls, based on the outputs of the home position sensor 70*b* and encoder sensor 73, the main motor 81 in such a manner as to bring the print drum 1*b* to its home position or dismount position. When the print drum 1*b* reaches the home position (YES, step S56), the controller 200 stops driving the main motor 81 and thereby stops the print drum 1*b* at the home position (step S57). At this time, the controller 200 causes the second "Ready" LED 118 to glow in green on the operation panel.

In the above condition, the operator pulls out the drum unit 100*b* in the same manner as in the step S49 of the third specific operation. The drum units 100*a* and 100*b* may be inserted into the housing 501 in the same manner as in the third specific operation.

In the fourth specific operation, the operator should only press the two drum unlock keys 114 and 115 at the same time. The fourth specific operation therefore makes the operator's manipulation simple and easy, compared to the third specific operation.

Fifth Specific Operation

A fifth specific operation to be described with reference to FIG. 19 relates to a manual insertion mode for allowing the operator to successively insert the drum unit 100*a* and 100*b* into the housing 501. For this specific operation, use is mainly made of the ninth, tenth and twelfth functions of the controller 200. Neither one of the drum units 100*a* and 100*b* is assumed to be initially present in the housing 501.

Figure 19:
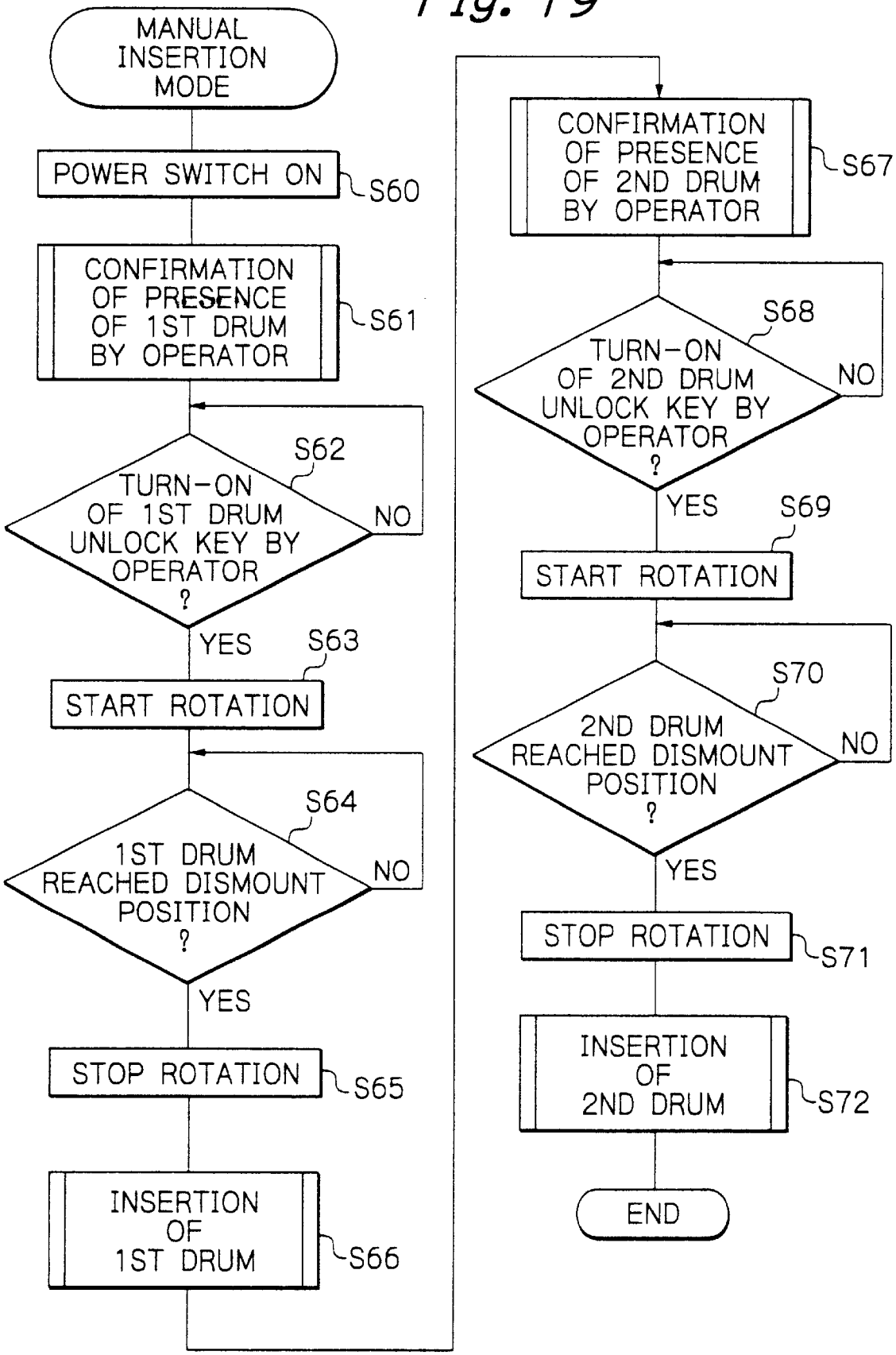

As shown in FIG. 19, the operator first turns on the power switch 95 (step S60). In response, the printer 500 becomes ready to perform a printing operation. Specifically, the LEDs 116 through 119 and LCD 120 on the operation panel 110 and the LEDs 96 through 99 adjoining the openings 501*a* and 501*b* are prepared for display. The operator watches the LCD 120 to see if the drum unit 100*a* (print drum 1) is present in the housing 501 or not (step S61). For this purpose, an exemplary message "Please insert drum units 100*a* and 100*b*." is displayed on the LCD 120. If desired, such a message may be replaced with LED sensors arranged on the operation panel 110 and responsive to the presence of the print drums 1*a* and 1*b*. Further, if it is not necessary to promote efficient operation, the operator may, of course, open the door cover 503 and see if the drum units 100*a* and 100*b* are present in the housing 501 or not.

Subsequently, the operator presses the first drum unlock key 114 ih order to insert the drum unit 100*a* into the housing 501 (YES, step S62). In response, the controller 200 drives the main motor 81 and thereby starts rotating the drum drive plate 87 assigned to the print drum 1*a* via the rotation transmitting means (step S63). At the same time, the controller 200 causes the first "Ready" LED 116 on the operation panel 110 to blink in green while causing the second "Unready" LED 119 to glow in red. This informs the operator of the fact that the drum unit 100*b* cannot be mounted, urging the operator to wait until the end of rotation of the drum drive plate 87.

When the drum drive plate 87 assigned to the print drum 1*a* reaches its home position (YES, step 64), the controller

200 stops driving the main motor 81 and thereby stops the above drum drive plate 87 at the home position (step S65). At the same time, the controller 200 causes the first "Ready" LED 116 to glow. in green, showing the operator that the coupling portion assigned to the print drum 1*a* is ready to receive the drum unit 100*a*.

Subsequently, the operator inserts the drum unit 100*a* into the housing 501 (step S66). Specifically, watching the first "Ready" LED 116 glowing in green on the operation panel 110, the operator opens the door 503. In response to the resulting output of the door sensor 504, the controller 200 causes the first "Ready" LED 96 and second "Unready" LED 99 to glow in green and red, respectively. The operator, seeing such statuses of the LEDs 96 and 99, inserts the drum unit 100*a* into the opening 501*a* via the mounting/dismounting means 50*a*. The drum unit 100*a* can be easily inserted and set because of the home position of the drum drive plate 87 assigned to the print drum 1*a*. The operator then closes the door 503.

After the operator has closed the door 503, an exemplary message "Drum unit 100*b* is absent." appears on the LCD 120 of the operation panel 110, showing the operator that the drum unit 100*b* is absent (step S67). Watching this message, the operator presses the second drum unlock key 115 (YES, step S68). In response, the controller 200 drives the main motor 81 and thereby starts rotating the drum drive plate 87 assigned to the print drum 1*b* via the rotation drive means (step S69). At the same time, the controller 200 causes the second "Ready" LED 118 to blink in green, causes the second "Unready" LED 119 to turn off, and causes the first "Unready" LED 117 to glow in red. This informs the operator of the fact that the drum unit 100*b* cannot be mounted, urging the operator to wait until the end of rotation of the above drum drive plate 87.

When the drum drive plate 87 assigned to the print drum 1*b* reaches the home position (YES, step S70), the controller 200 stops driving the main motor 81 and thereby stops the drum drive plate 87 at the home position (step S71). Also, the controller 200 causes the second "Ready" LED 118 to glow in green, showing the operator that the coupling portion assigned to the print drum 1*b* is ready to receive the drum unit 100*b*.

Thereafter, the operator inserts the drum unit 100*b* into the housing 501 in the same manner as the drum unit 100*a* (step S72). Specifically, watching the second "Ready" LED 118 glowing in green on the operation panel 110, the operator opens the door 503 for inserting the drum unit 100*b*. In response to the resulting output of the door sensor 504, the controller 200 causes the second "Ready" LED 98 to glow in green and causes the first "Unready" LED 97 to glow in red. When the operator, watching the LEDs 98 and 97, inserts the drum unit 100*b* into the opening 501*b* via the mounting/dismounting means 50*b*, the drum unit 100*b* can be easily inserted and set because of the home position of the drum drive plate 87.

Sixth Specific Operation

A sixth specific operation to be described with reference to FIG. 20 pertains to an automatic insertion mode that allows the operator to successively insert the drum units 100*a* and 100*b* for the same purpose as the fifth specific operation. For the sixth specific operation, use is mainly made of the ninth, tenth and thirteenth functions available with the controller 200. Again, neither one of the drum units 100*a* and 100*b* is assumed to be initially present in the housing 501.

Figure 20:
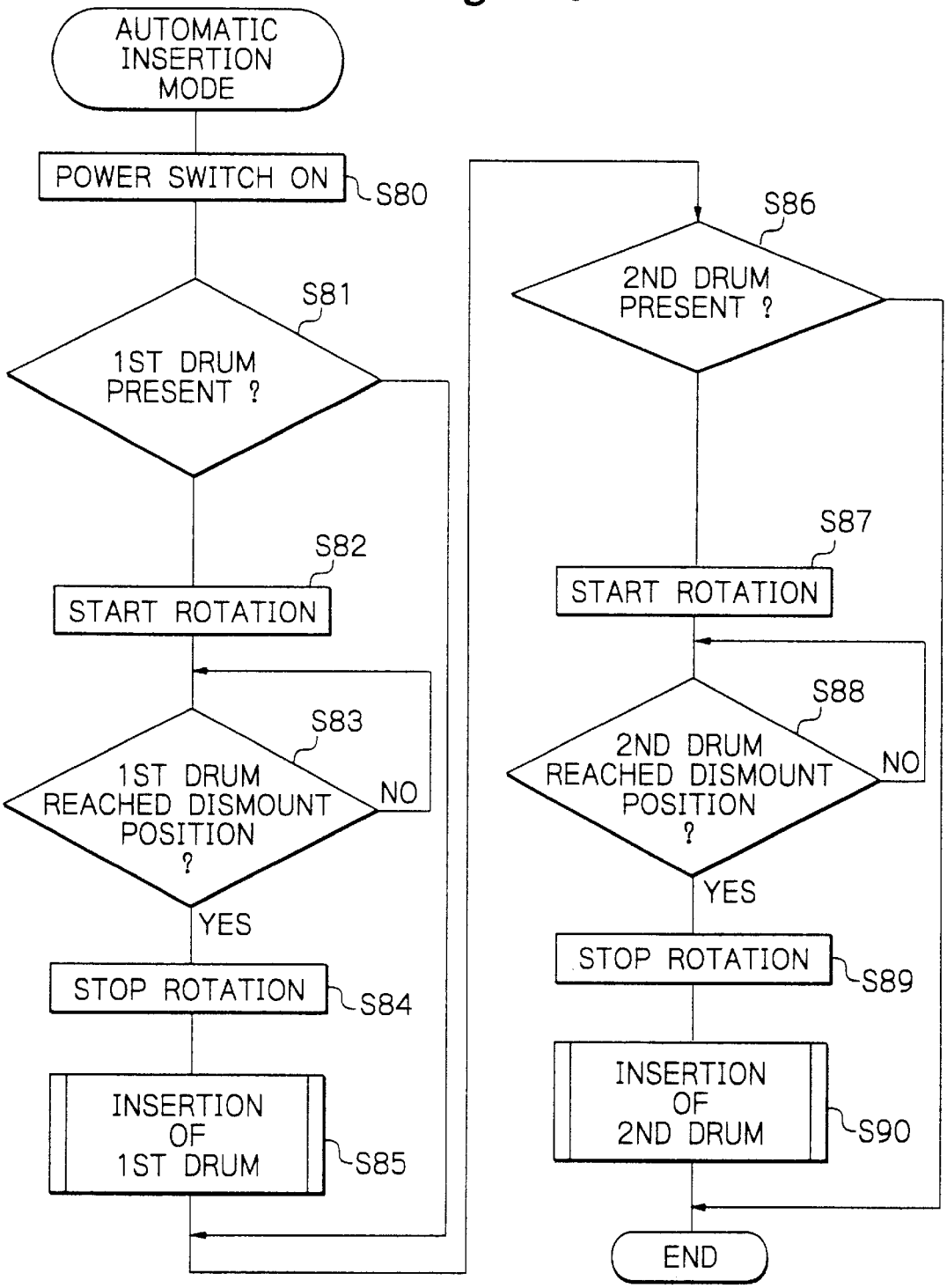

As shown in FIG. 20, the operator first turns on the power switch 95 (step S80). In response, the printer 500 becomes ready to perform a printing operation. Subsequently, the controller 200 automatically determines whether or not the drum unit 100*a* is present on the basis of the outputs of the drum sensors 77 and 78 (step S81). Because the drum unit 100*a*, i.e., the print drum 1*a* is absent at this stage, as indicated by the output of the first drum sensor 77 (NO, step S81), the controller 200 executes a step S82. If the answer of the step S81 is YES, the controller 200 executes a step S86. The steps S82 to S85 are identical with the steps S63 to S66 of the fifth specific operation, FIG. 19.

Subsequently, the controller 200 automatically determines whether or not the drum unit 100*b* is present on the basis of the outputs of the drum sensors 77 and 78 (step S86). If the answer of the step S86 is NO, the controller 200 executes a step S87; if otherwise, the controller 200 ends the procedure shown in FIG. 20. The steps S87 to S90 are identical with the steps S69 to S72 of the fifth specific operation shown in FIG. 19.

The RAM 202 stores priority order as to the insertion of the print drums 1*a* and 1*b* into the housing 501, as stated earlier. The controller 200 may therefore sequentially set the print drums 1*b* and 1*a* in this order in accordance with the priority order.

A first modification of the illustrative embodiment will be described hereinafter. The modification differs from the illustrative embodiment in the following aspect. The mechanical locking means associated with the drum units 100*a* and 100*b* are replaced with electric locking means respectively assigned to the drum units 100*a* and 100*b* for locking them to the housing 601. The first and second drum unlock keys 114 and 115 play the role of unlock setting means for canceling locked states set up by the electric locking means in addition to the previously stated function. The controller 200 controls the electric locking means for canceling the locked state of the drum unit 100*a* or 100*b* to be dismounted on the basis of the output of the drum unlock key 114 or 115.

The electric locking means each may be implemented as, e.g., electric locking means 175 shown in FIGS. 8 and 9 of Laid-Open Publication No. 10-846 mentioned earlier. Obviously, the controller 200 combined with the electric locking means 175 is capable of executing any one of the first to sixth specific operations.

A second modification of the illustrative embodiment differs from the illustrative embodiment in the following respect. Again, the mechanical locking means associated with the drum units 100*a* and 100*b* are replaced with electric locking means respectively assigned to the drum units 100*a* and 100*b* for locking them to the housing 601. The first and second drum unlock keys 114 and 115 play the role of unlock setting means for canceling locked states set up by the electric locking means for the drum units 100*a* and 100*b* to be continuously dismounted in addition to the previously stated function. The control means 200 controls, in response to a signal to appear when the operator presses the keys 114 and 115 at the same time, the electric locking means in such a manner as to unlock the drum unit 100*a* or 100*b* to be dismounted.

Again, the electric locking means each may be implemented as, e.g., electric locking means 175 shown in FIGS. 8 and 9 of Laid-Open Publication No. 10-846 mentioned earlier. Obviously, the controller 200 combined with the electric locking means 175 is capable of executing any one of the first to sixth specific operations.

A third modification of the illustrative embodiment will be described hereinafter. The third modification is implemented as a stencil printer designated by the parenthesized reference numeral 700. The stencil printer is identical with the stencil printer 500 except that it additionally includes the master discharging devices 42*a* and 42*b* and master making devices 41*a* and 41*b* indicated by phantom lines as well as a scanner not shown.

The master making devices 41*a* and 41*b,* master discharging devices 42*a* and 42*b* and scanner are constructed in the same manner as in, e.g., FIG. 8 of Laid-Open Publication No. 5-229243. The scanner includes a group of mirrors and a lens. Interposed between the mirrors and the lens is an arrangement having various functions necessary for color separation essential with color printing, e.g., a filter unit including a plurality of color filters as taught in, e.g., Laid-Open Publication No. 64-18682. The above devices automatically effect master making, master discharging and other procedures in the same manner as taught in Laid-Open Publication NO. 64-18682. Data for making masters may be generated by a computer or similar data processing apparatus in place of the scanner, if desired.

The operation of the printer 700 is identical with the operation described in paragraphs (0088) through (0096) of Laid-Open Publication No. 11-138961 and will not be described specifically. The printer 700 can, of course, perform the first to sixth specific operations.

In the illustrative embodiment and modifications thereof, the print drums 1*a* and 1*b* are assumed to be located at home positions when the dampers 5*a* and 5*b,* respectively, are located at the bottoms of the drums 1*a* and 1*b*. Alternatively, the home positions may be such that the dampers 5*a* and 5*b* are positioned at the tops of the print drums 1*a* and 1*b,* respectively. The crux is that the home positions be identical throughout the printer 500 or 700.

The construction and arrangement of the individual device included in the printer 500 or 700 is only illustrative and may be replaced with any other conventional device and arrangement. For example, the air knives 7*a* and 7*b* may be replaced with conventional angularly movable peelers adjoining the print drums 1*a* and 1*b*.

The present invention is, of course, applicable to a stencil printer having three or more print drums. Further, the present invention may be implemented as a stencil printer including a plurality of print drums to each of which ink of particular color is fed from outside the print drum, as disclosed in, e.g., Laid-Open Publication No. 7-17013 mentioned earlier.

Moreover, for the mounting/dismounting means for allowing the print drums to be mounted and dismounted from the housing, use may be made of an arrangement shown in FIG. 1 and 2 of Laid-Open Publication No. 64-46258, holding means 36 and a print drum device 55 shown in FIG. 2 and 3 of Laid-Open Publication No. 5-229243, an arrangement shown in FIG. 3 of Laid-Open Publication No. 6-71998, an arrangement shown in FIG. 1 of Laid-Open Publication No. 6-293175, or an arrangement shown in FIG. 2 of Laid-Open Publication No. 7-1817.

In summary, it will be seen that the present invention provides a stencil printer with a plurality of print drums having various unprecedented advantages, as enumerated below.

(1) A print drum to be dismounted can be dismounted without resorting to conventional top-bottom movement adjusting means including top-bottom moving means, so that the printer has a compact configuration. Only if a drum unit to be dismounted is brought to a removable condition via individual removal setting means, the print drum of the drum unit can be automatically moved to a preselected phase and easily removed from a printer body. This eliminates the need for conventional sophisticated manual operation, i.e., returning each print drum to its home position or similar dismount position and then removing it. The operator of the printer can therefore easily remove drum units for the purpose of, e.g., successively replacing the print drums of first and second colors in the event of four-color printing, removing a paper sheet or a master jamming a path between nearby print drums, or performing cleaning.

(2) The operator can surely operate the printer because of controlled unlocking operation.

(3) Only if at least two drum units are successively brought to their dismount positions via successive removal setting means, the print drums of such drums units can be automatically and consecutively moved to a preselected phase and easily removed from the printer body.

(4) The individual removal setting means plays the role of successive removal setting means at the same time, so that the number of parts is reduced.

(5) The operator can immediately see a drum unit to be dealt with as to the defective egress of a paper sheet.

(6) The operator is prevented from forgetting to deal with defective paper egress that would cause another defective paper egress to occur.

(7) Drum drive means is simple in configuration.

(8) The phase of the individual print drum can be surely sensed while angular position sensing means responsive to the angular position of the print drum can be simplified in configuration.

(91) Whether or not the individual print drum is ready to be mounted or dismounted is indicated at a position easy for the operator to see, enhancing efficient operation. In addition, a particular color is assigned to each of a ready state and an unready state, further enhancing efficient operation.

(10) Only if the operator turns on a power switch and conditions the printer for the insertion of a desired drum unit via individual insertion setting means, a coupling portion included in the printer and assigned to the above drum unit is automatically moved to a preselected phase. In this condition, the operator can easily insert the drum unit into the printer body. This is also successful to enhance efficient operation.

Various modifications will become possible for those skilled in the art after receiving the teachings of the present disclosure without departing from the scope thereof.

What is claimed is:

1. A printer including a plurality of drum units removably mounted to a printer body and each including a respective print drum allowing a particular master to be wrapped therearound, nearby print drums being provided with a preselected initial phase difference therebetween beforehand when said drum units are present in said printer body, said plurality of drum units each being removable from said printer body when said respective print drum is brought to a preselected phase, said printer wrapping said particular master around said respective print drum, feeding ink of particular color to each master, and pressing a recording medium against consecutive masters to thereby effect continuous printing, said printer comprising:

individual removal setting means each being assigned to a particular drum unit for making said drum unit removable from the printer body;

angular position sensing means for sensing an angular position of the drum of the individual drum unit;

drum drive means for causing the print drum of the drum unit to be removed to rotate; and control means for controlling, based on an output of said individual removal setting means assigned to the drum unit to be removed and an output of the angular position sensing means assigned to the print drum of said drum unit, said drum drive means such that said print drum of said drum unit to be removed is brought to the preselected phase.

2. A printer as claimed in claim 1, further comprising locking means each being assigned to a particular drum unit for locking said drum unit to the printer body, wherein said individual removal setting means includes individual unlock setting means for unlocking the drum unit to be removed and locked by said locking means to thereby make said drum unit removable, and wherein said control means controls, based on an output of said individual unlock setting means, said locking means in such a manner as to unlock said drum unit to be removed.

3. A printer as claimed in claim 1, further comprising:

an openable member mounted on the printer body for selectively opening or closing openings formed in said printer body and each opening being assigned to a particular drum unit; and open/close sensing means for determining whether said openable member is open or closed;

wherein when another drum unit should be removed, said control means controls, based on an output of said open/close sensing means appearing when an operator of said printer opens said openable member for removing the drum unit to be removed and then closes said openable member, an output of said individual removal setting means assigned to said another drum unit and an output of said angular position sensing means assigned to said another drum unit, said drum drive means such that the print drum of said another drum unit is brought to the preselected phase.

4. A printer as claimed in claim 3, further comprising displaying means each being assigned to a particular drum unit for displaying whether or not said drum unit can be mounted or dismounted, said displaying means being positioned at least around said openings or on an operation panel.

5. A printer as claimed in claim 4, wherein said displaying means comprises LEDs indicating whether or not the individual drum unit can be mounted or dismounted in color.

6. A printer as claimed in claim 1, wherein the plurality of drum units are arranged side by side in a direction in which the recording medium is conveyed, said printer further comprising:

paper egress sensing means each being located downstream, in said direction, of the print drum of a particular drum unit present in the printer body for detecting a roll-up, defective egress or similar egress error of the recording medium; and informing means for informing, based on an output of each of said paper egress sensing means, an operator of said printer of the drum unit where the egress error has occurred.

7. A printer as claimed in claim 6, further comprising:

an openable member mounted on the printer body for selectively opening or closing openings formed in said printer body and each opening being assigned to a particular drum unit; and open/close sensing means for determining whether said openable member is open or closed;

said control means determining whether or not to perform a printing operation on the basis of an output of said open/close sensing means and outputs of said paper egress sensing means.

8. A printer as claimed in claim 1, wherein said drum drive means comprises a single drive source and rotation transmitting means for transmitting a rotation of said single drive source to the print drums of the drum units present on the printer body.

9. A printer as claimed in claim 8, wherein the plurality of drum units are arranged side by side in a direction in which the recording medium is conveyed, said angular position sensing means each comprising:

home position sensing means for sensing a home position assigned to the respective print drum and corresponding to the preselected phase; and a pulse encoder mounted on a most upstream drum unit in said direction for sensing a phase of the print drum of said most upstream drum unit.

10. A printer as claimed in claim 1, wherein the drum units each comprises locking means for selectively locking or unlocking the respective drum unit to or from the printer body in interlocked relation to an insertion or a removal of said drum unit to or from said printer body.

11. A printer including a plurality of drum units removably mounted to a printer body and each including a respective print drum allowing a particular master to be wrapped therearound, nearby print drums being provided with a preselected initial phase difference therebetween beforehand when said drum units are present in said printer body, said plurality of drum units each being removable from said printer body when said respective print drum is brought to a preselected phase, said printer wrapping said particular master around said respective print drum, feeding ink of particular color to each master, and pressing a recording medium against consecutive masters to thereby effect continuous printing, said printer comprising:

successive removal setting means for successively making at least two drum units removable from the printer body;

angular position sensing means for sensing an angular position of the print drum of the individual drum unit;

drum drive means for causing the print drum of the drum unit to be removed to rotate; and control means for controlling, based on an output of said successive removal setting means and an output of said angular position sensing means assigned to the print drum of one drum unit to be removed, said drum drive means such that said print drum of said one drum unit is brought to the preselected phase, and then controlling, based on an output of said angular position sensing means assigned to the print drum of another drum unit to be removed, said drum drive means such that the print drum of said another drum unit is brought to said preselected phase.

12. A printer as claimed in claim 11, further comprising individual removal setting means each being assigned to a particular drum unit for making said drum unit removable from the printer body, wherein said successive removal setting means comprises at least two individual removal setting means.

13. A printer as claimed in claim 11, further comprising locking means each being assigned to a particular drum unit for locking said drum unit to the printer body, wherein said successive removal setting means comprises successive unlock setting means for unlocking the drum units to be successively removed and locked by the respective locking means to thereby make said drum units to be successively removable, and wherein said control means controls, based on an output of said successive unlock setting means, the locking means assigned to one drum unit to be removed in such a manner as to unlock said one drum unit, and controls the locking means assigned to another drum unit to be removed in such a manner as to unlock said another drum unit.

14. A printer as claimed in claim 11, further comprising:

an openable member mounted on the printer body for selectively opening or closing openings formed in said printer body and each opening being assigned to a particular drum unit; and open/close sensing means for determining whether said openable member is open or closed;

wherein said control means controls, based on an output of said open/close sensing means appearing when an operator of said printer opens said openable member for removing one drum unit to be removed and then closes said openable member and an output of said angular position sensing means assigned to the print drum of another drum unit to be removed, said drum drive means such that said print drum of said another drum unit is brought to the preselected phase.

15. A printer as claimed in claim 14, further comprising displaying means each being assigned to a particular drum unit for displaying whether or not said drum unit can be mounted or dismounted, said displaying means being positioned at least around said openings or on an operation panel.

16. A printer as claimed in claim 15, wherein said displaying means comprises LEDs indicating whether or not the individual drum unit can be mounted or dismounted in color.

17. A printer as claimed in claim 11, wherein the plurality of drum units are arranged side by side in a direction in which the recording medium is conveyed, said printer further comprising:

paper egress sensing means each being located downstream, in said direction, of the print drum of a particular drum unit present in the printer body for detecting a roll-up, defective egress or similar egress error of the recording medium; and informing means for informing, based on an output of each of said paper egress sensing means, an operator of said printer of the drum unit where the egress error has occurred.

18. A printer as claimed in claim 17, further comprising:

an openable member mounted on the printer body for selectively opening or closing openings formed in said printer body and each opening being assigned to a particular drum unit; and open/close sensing means for determining whether said openable member is open or closed;

wherein said control means determines whether or not to perform a printing operation on the basis of an output of said open/close sensing means and outputs of said paper egress sensing means.

19. A printer as claimed in claim 11, wherein said drum drive means comprises a single drive source and rotation transmitting means for transmitting a rotation of said single drive source to the print drums of the drum units present on said printer body.

20. A printer as claimed in claim 19, wherein the plurality of drum units are arranged side by side in a direction in which the recording medium is conveyed, said angular position sensing means each comprising:

home position sensing means for sensing a home position assigned to the respective print drum and corresponding to the preselected phase; and a pulse encoder mounted on a most upstream drum unit in said direction for sensing a phase of the print drum of said most upstream drum unit.

21. A printer as claimed in claim 11, wherein the drum units each comprises locking means for selectively locking or unlocking the respective drum unit to or from the printer body in interlocked relation to an insertion or a removal of said drum unit to or from said printer body.

22. A printer including a plurality of drum units removably mounted to a printer body and arranged side by side in a direction in which a recording medium is conveyed and each including a respective print drum allowing a particular master to be wrapped therearound, nearby print drums being provided with a preselected initial phase difference therebetween beforehand when said drum-units are present in said printer body, said plurality of drum units each being removable from said printer body when said respective print drum is brought to a preselected phase, said printer wrapping said particular master around said respective print drum, feeding ink of particular color to each master, and pressing a recording medium against consecutive masters to thereby effect continuous printing, said printer comprising:

paper egress sensing means each being located downstream, in said direction, of the print drum of a particular drum unit present in the printer body for detecting a roll-up, defective egress or similar egress error of the recording medium;

angular position sensing means for sensing an angular position of the print drum of the individual drum unit;

drum drive means for causing the print drum of the drum unit to be removed to rotate; and control means for controlling, based on outputs of said paper egress sensing means and an output of said angular position sensing means assigned to the print drum of one drum unit to be removed due to an egress error, said drum drive means such that said print drum of said one drum-unit to be removed is brought to the preselected phase, and then controlling, based on the outputs of said paper egress sensing means and an output of said angular position sensing means assigned to the print drum of another drum unit to be removed due to an egress error, said drum drive means such that the print drum of said another drum unit is brought to said preselected phase.

23. A printer as claimed in claim 22, further comprising:

an openable member mounted on the printer body for selectively opening or closing openings formed in said printer body and each opening being assigned to a particular drum unit; and open/close sensing means for determining whether said openable member is open or closed;

wherein said control means controls, based on an output of said open/close sensing means appearing when an operator of said printer opens said openable member for removing the one drum unit to be removed and then closes said openable member and an output of said angular position sensing means assigned to the print drum of another drum unit to be removed, said drum drive means such that said print drum of said another drum unit is brought to the preselected phase.

24. A printer as claimed in claim 23, further comprising displaying means each being assigned to a particular drum unit for displaying whether or not said drum unit can be mounted or dismounted, said displaying means being positioned at least around said openings or on an operation panel.

25. A printer as claimed in claim 24, wherein said displaying means comprises LEDs indicating whether or not the individual drum unit can be mounted or dismounted in color.

26. A printer as claimed in claim 22, further comprising informing means for informing, based on an output of each of said paper egress sensing means, an operator of said printer of the drum unit where the egress error has occurred.

27. A printer as claimed in claim 22, further comprising:

an openable member mounted on the printer body for selectively opening or closing openings formed in said printer body and each opening being assigned to a particular drum unit; and open/close sensing means for determining whether said openable member is open or closed;

wherein said control means determines whether or not to perform a printing operation on the basis of an output of said open/close sensing means and outputs of said paper egress sensing means.

28. A printer as claimed in claim 22, wherein said drum drive means comprises a single drive source and rotation transmitting means for transmitting a rotation of said single drive source to the print drums of the drum units present on the printer body.

29. A printer as claimed in claim 22, wherein said angular position sensing means each comprises:

home position sensing means for sensing a home position assigned to the respective print drum and corresponding to the preselected phase; and a pulse encoder mounted on a most upstream drum unit in said direction for sensing a phase of the print drum of said most upstream drum unit.

30. A printer including a plurality of drum units removably mounted to a printer body and each including a respective print drum allowing a particular master to be wrapped therearound, nearby print drums being provided with a preselected initial phase difference therebetween beforehand when said drum units are present in said printer body, said plurality of drum units each being insertable into said printer body when said respective print drum is brought to a preselected phase, said printer wrapping said particular master around said respective print drum, feeding ink of particular color to each master, and pressing a recording medium against consecutive masters to thereby effect continuous printing, said printer comprising:

a power switch for selectively setting up or interrupting power supply to said printer;

individual removal setting means each being assigned to a particular drum unit for making said drum unit insertable into the printer body;

angular position sensing means for sensing an angular position of the drum of the individual drum unit;

drum drive means for causing the print drum of the drum unit to be inserted to rotate; and control means for controlling, after a turn-on of said power switch and on the basis of an output of said individual removal setting means assigned to the drum unit to be inserted and an output of said angular position sensing means assigned to the print drum of said drum unit, said drum drive means such that a coupling portion arranged in the printer body and assigned to said print drum of said drum unit to be inserted is brought to the preselected phase.

31. A printer as claimed in claim 30, further comprising:

an openable member mounted on the printer body for selectively opening or closing openings formed in said printer body and each opening being assigned to a particular drum unit; and open/close sensing means for determining whether said openable member is open or closed;

wherein when another drum unit should be inserted, said control means controls, based on an output of said open/close sensing means appearing when an operator of said printer opens said openable member for inserting the drum unit to be removed and then closes said openable member, an output of said individual removal setting means assigned to said another drum unit and an output of said angular position sensing means assigned to said another drum unit, said drum drive means such that said coupling portion is brought to the preselected phase.

32. A printer as claimed in claim 31, wherein the plurality of drum units are arranged side by side in a direction in which the recording medium is conveyed, said printer further comprising paper egress sensing means each being located downstream, in said direction, of the print drum of a particular drum unit present in the printer body for detecting a roll-up, defective egress or similar egress error of the recording medium, said control means determining whether or not to perform a printing operation on the basis of an output of said open/close sensing means and outputs of said paper egress sensing means.

33. A printer as claimed in claim 31, further comprising informing means for informing, based on an output of each of said paper egress sensing means, an operator of said printer of the drum unit where the egress error has occurred.

34. A printer as claimed in claim 31, further comprising displaying means each being assigned to a particular drum unit for displaying whether or not said drum unit can be mounted or dismounted, said displaying means being positioned at least around said openings or on an operation panel.

35. A printer as claimed in claim 34, wherein said displaying means comprises LEDs indicating whether or not the individual drum unit can be mounted or dismounted in color.

36. A printer as claimed in claim 30, wherein said drum drive means comprises a single drive source and rotation transmitting means for transmitting a rotation of said single drive source to the print drums of the drum units present on the printer body.

37. A printer as claimed in claim 30, wherein the plurality of drum units are arranged side by side in a direction in which the recording medium is conveyed, said angular position sensing means each comprising:

home position sensing means for sensing a home position assigned to the respective print drum and corresponding to the preselected phase; and a pulse encoder mounted on a most upstream drum unit in said direction for sensing a phase of the print drum of said most upstream drum unit.

38. A printer including a plurality of drum units removably mounted to a printer body and each including a respective print drum allowing a particular master to be wrapped therearound, nearby print drums being provided with a preselected initial phase difference therebetween beforehand when said drum units are present in said printer body, said plurality of drum units each being insertable into said printer body when said respective print drum is brought to a preselected phase, said printer wrapping said particular master around said respective print drum, feeding ink of particular color to each master, and pressing a recording medium against consecutive masters to thereby effect continuous printing, said printer comprising:

a power switch for selectively setting up or interrupting power supply to said printer;

drum sensing means each being assigned to a particular drum unit for determining whether or not said drum unit is present on the printer body;

angular position sensing means for sensing an angular position of the drum of the individual drum unit;

drum drive means for causing the print drum of the drum unit to be inserted to rotate; and control means for controlling, after a turn-on of said power switch and on the basis of an output of said drum sensing means assigned to one drum unit to be inserted and an output of said angular position sensing means assigned to the print drum of said drum unit, said drum drive means such that a coupling portion arranged in the printer body and assigned to said print drum of said drum unit to be inserted is brought to the preselected phase, and then controlling, based on an output of said drum sensing means assigned to the print drum of another drum unit to be inserted and an output of said angular position sensing means assigned to said print drum of said drum unit, said drum drive means such that a coupling portion arranged in said printer body and assigned to said another drum unit is brought to said preselected phase.

39. A printer as claimed in claim 38, wherein the plurality of print drums are arranged side by side in a direction in which the recording medium is conveyed, said printer further comprising:

paper egress sensing means each being located downstream, in said direction, of the print drum of a particular drum unit present in the printer body for detecting a roll-up, defective egress or similar egress error of the recording medium;

an openable member mounted on the printer body for selectively opening or closing openings formed in said printer body and each opening being assigned to a particular drum unit; and open/close sensing means for determining whether said openable member is open or closed;

said control means determining whether or not to perform a printing operation on the basis of an output of said open/close sensing means and outputs of said paper egress sensing means.

40. A printer as claimed in claim 39, further comprising displaying means each being assigned to a particular drum unit for displaying whether or not said drum unit can be mounted or dismounted, said displaying means being positioned at least around said openings or on an operation panel.

41. A printer as claimed in claim 40, wherein said displaying means comprises LEDs indicating whether or not the individual drum unit can be mounted or dismounted in color.

42. A printer as claimed in claim 38, further comprising informing means for informing, based on an output of each of said paper egress sensing means, an operator of said printer of the drum unit where the egress error has occurred.

43. A printer as claimed in claim 38, wherein said drum drive means comprises a single drive source and rotation transmitting means for transmitting a rotation of said single drive source to the print drums of the drum units present on the printer body.

44. A printer as claimed in claim 38, wherein the plurality of drum units are arranged side by side in a direction in which the recording medium is conveyed, said angular position sensing means each comprising:

home position sensing means for sensing a home position assigned to the respective print drum and corresponding to the preselected phase; and a pulse encoder mounted on a most upstream drum unit in said direction for sensing a phase of the print drum of said most upstream drum unit.

45. A printer including a plurality of drum units removably mounted to a printer body and each including a respective print drum allowing a particular master to be wrapped therearound, nearby print drums being provided with a preselected initial phase difference therebetween beforehand when said drum units are present in said printer body, said plurality of drum-units each being insertable into said printer body when said respective print drum is brought to a preselected phase, said printer wrapping said particular master around said respective print drum, feeding ink of particular color to each master, and pressing a recording medium against consecutive masters to thereby effect continuous printing, said printer comprising:

drum sensing means each being assigned to a particular drum unit for determining whether or not said drum unit is present on the printer body;

angular position sensing means for sensing an angular position of the drum of the individual drum unit;

drum drive means for causing the print drum of the drum unit to be inserted to rotate; and control means for controlling, when one drum unit is inserted into the printer body on which no drum units are present, said drum drive means on the basis of outputs of said drum sensing means such that a coupling portion arranged in said printer body and assigned to another drum unit to be inserted is brought to the preselected phase.

46. A printer as claimed in claim 45, wherein the plurality of drum units are arranged side by side in a direction in which the recording medium is conveyed, said printer further comprising:

paper egress sensing means each being located downstream, in said direction, of the print drum of a particular drum unit present in the printer body for detecting a roll-up, defective egress or similar egress error of the recording medium;

an openable member mounted on the printer body for selectively opening or closing openings formed in said printer body and each opening being assigned to a particular drum unit; and open/close sensing means for determining whether said openable member is open or closed;

said control means determining whether or not to perform a printing operation on the basis of an output of said open/close sensing means and outputs of said paper egress sensing means.

47. A printer as claimed in claim 46, further comprising informing means for informing, based on an output of each of said paper egress sensing means, an operator of said printer of the drum unit where the egress error has occurred.

48. A printer as claimed in claim 45, wherein said drum drive means comprises a single drive source and rotation transmitting means for transmitting a rotation of said single drive source to the print drums of the drum units present on the printer body.

49. A printer as claimed in claim 45, wherein the plurality of drum units are arranged side by side in a direction in which the recording medium is conveyed, said angular position sensing means each comprising:

home position sensing means for sensing a home position assigned to the respective print drum and corresponding to the preselected phase; and a pulse encoder mounted on a most upstream drum unit in said direction for sensing a phase of the print drum of said most upstream drum unit.

* * * * *

UNITED STATES PATENT AND TRADEMARK OFFICE

CERTIFICATE OF CORRECTION

PATENT NO. : 6,356,293 B1
DATED : March 12, 2002
INVENTOR(S) : Hiroyuki Chiba

It is certified that error appears in the above-identified patent and that said Letters Patent is hereby corrected as shown below:

Column 4,
Line 16, change “dampers” to -- clampers --.

Column 5,
Lines 27 and 30, change “damper” to -- clamper --.

Column 8,
Line 7, change “damper” to -- clamper --.

Column 10,
Line 53, change “″Unready″” to -- “Unready” --.

Column 12,
Line 23, change “damper” to -- clamper --.

Column 13,
Lines 3 and 30, change “dampers” to -- clampers --.

Column 17,
Line 8, change “19” to -- 119 --;
Line 56, change “stores.” to -- stores --.

Column 18,
Line 9, change “damper” to -- clamper --.

Column 19,
Line 40, change “damper” to -- clamper --.

Column 24,
Lines 15 and 48, change “he” to -- the --.

Column 26,
Line 54, change “ih”to -- in --.

UNITED STATES PATENT AND TRADEMARK OFFICE

CERTIFICATE OF CORRECTION

PATENT NO. : 6,356,293 B1
DATED : March 12, 2002
INVENTOR(S) : Hiroyuki Chiba

It is certified that error appears in the above-identified patent and that said Letters Patent is hereby corrected as shown below:

Column 29,
Lines 30 and 32, change “dampers” to -- clampers --.

Signed and Sealed this

Fourth Day of June, 2002

*Attest:*

*Attesting Officer*

JAMES E. ROGAN
*Director of the United States Patent and Trademark Office*